US007937008B2

(12) United States Patent
Fujishima et al.

(10) Patent No.: US 7,937,008 B2
(45) Date of Patent: May 3, 2011

(54) IMAGE FORMING APPARATUS AND IMAGE FORMING METHOD

(75) Inventors: Masashi Fujishima, Osaka (JP); Akihiro Watanabe, Osaka (JP); Sayo Uemura, Osaka (JP); Yukihiro Mori, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 657 days.

(21) Appl. No.: 12/068,794

(22) Filed: Feb. 12, 2008

(65) Prior Publication Data

US 2008/0206661 A1 Aug. 28, 2008

(30) Foreign Application Priority Data

Feb. 14, 2007 (JP) ..... 2007-033925
Feb. 23, 2007 (JP) ..... 2007-044408
Mar. 15, 2007 (JP) ..... 2007-067545

(51) Int. Cl.
*G03G 15/00* (2006.01)
*G03G 15/06* (2006.01)
*G03G 15/09* (2006.01)
*G03G 15/08* (2006.01)

(52) U.S. Cl. ..... 399/49; 399/48; 399/55; 399/267; 399/271; 399/285

(58) Field of Classification Search ..... 399/49, 399/55, 267, 271, 285
See application file for complete search history.

(56) References Cited

U.S. PATENT DOCUMENTS 5,832,350 A * 11/1998 Kumasaka et al. ..... 399/282
6,512,909 B2 * 1/2003 Ozawa et al. ..... 399/270
6,829,448 B2 * 12/2004 Ozawa et al. ..... 399/55
7,280,773 B2 * 10/2007 Uno ..... 399/27
7,280,779 B2 * 10/2007 Fasen ..... 399/55
2002/0039496 A1 * 4/2002 Aoki et al. ..... 399/55
2006/0222390 A1 * 10/2006 Sasaki et al. ..... 399/55
2007/0071505 A1 * 3/2007 Do ..... 399/270
2007/0098461 A1 * 5/2007 Miyabe et al. ..... 399/285
2007/0280738 A1 * 12/2007 Uetake et al. ..... 399/253
2007/0292165 A1 * 12/2007 Hirayama et al. ..... 399/267
2008/0181675 A1 * 7/2008 Fujishima et al. ..... 399/267

FOREIGN PATENT DOCUMENTS

JP 08-137256 5/1996
JP 11-174792 7/1999
JP 2003-280357 10/2003
JP 2005-242194 9/2005

* cited by examiner

*Primary Examiner* — David M Gray
*Assistant Examiner* — Francis Gray
(74) *Attorney, Agent, or Firm* — Clark & Brody

(57) ABSTRACT

An image forming apparatus having a touchdown-development type developing apparatus, in which a toner collecting roller that collects scattered toner suspended in the vicinity of a toner holding body and a two-component developer holding body is arranged on the downstream side in a rotational direction of the two-component developer holding body from a closest position of the two-component developer holding body and the toner holding body, and between the two-component developer holding body and the housing wall, and further, bias means that applies a bias voltage for collecting the scattered toner to the toner collecting roller, and image density sensing means for sensing a density of a toner image developed on the electrostatic latent image holding body surface or a toner image on a transfer body onto which the toner image developed on the electrostatic latent image holding body surface is transferred to control the bias voltage are provided.

5 Claims, 11 Drawing Sheets

IMAGE FORMING APPARATUS AND IMAGE FORMING METHOD

BACKGROUND OF THE INVENTION

1. Field of the Invention

The present invention relates to an image forming apparatus such as a copier, printer, facsimile, and a complex machine of them, and particularly to an image forming apparatus adapted such that a two-component developer, which charges a nonmagnetic toner using a magnetic carrier, is utilized to form a magnetic brush, the magnetic brush forms a toner thin layer on a developing roller, and the toner of the toner thin layer flies on an electrostatic latent image to develop the latent image.

2. Description of Related Art

Conventionally, in an electrographic image forming apparatus, a one-component developing method and a two-component developing method have been known as a developing method using a dry toner.

In the one-component developing method, since no carrier is contained, an electrostatic latent image of a photoreceptor is not disturbed by the magnetic brush formed of the carrier and the toner, which is suitable for enhancing image quality. However, in the one-component developing method, it is difficult to stably maintain a charge amount of the toner. Moreover, in the case of color toner, since permeability is required, the toner needs to be a nonmagnetic toner. Thus, in many full-color image forming apparatuses, the two-component developing method, which uses a carrier as a medium charging and carrying the toner, is employed.

As an image forming method using the two-component developing method, an image forming method by a so-called touchdown development (also referred to as hybrid development) has been known in which a toner thin layer is formed on the toner holding body by the magnetic brush formed on a developer holding body that holds a two-component developer, and the toner thin layer on the toner holding body allows an electrostatic latent image on a electrostatic latent image holding body to be developed and visualized. However, in this developing method, the two-component developing method and the one-component developing method are combined, thereby posing a problem in that there is a difference between an appropriate charge amount of the toner when the electrostatic latent image is developed and an appropriate charge amount of the toner when the toner thin layer is formed. Thus, in some cases, a small amount of the toner in the toner thin layer causes an unfavorable image density, or a problem of development ghost and the like because of poor peeling of the toner thin layer that did not contribute to the development is posed.

Therefore, in Patent Document 1 (Japanese Patent Application Laid-Open No. 2003-280357), there is provided means for applying an AC bias with a duty ratio of 10 to 50% on which a DC bias is superimposed to the developing roll to prevent the occurrence of development ghost and selective development. However, as described above, since the optimal toner charge amount differs between at the time of thin layer formation and at the time of development, the above-described means may be insufficient as the measures.

Meanwhile, one of causes that pose the above-described problems is influence of scattered toner. With scatter of the toner, a developing apparatus is a major site of emergence, such as the scatter when the toner is stirred inside of a housing, and the scatter in the vicinity of the magnetic roller. The scattered toner occurring in the developing apparatus scatters to the inside of an electrophotographic apparatus in which the electrostatic latent image holding body, an optical system apparatus, a charging apparatus, a transfer apparatus and the like are arranged, thereby resulting in various poor images, improper operations and the like including the above-described problems.

In order to solve these problems, Patent Document 2 (Japanese Patent Application Laid-Open No. H8-137256) proposes that a scatter preventing member that is rotatably provided away from, and opposed to the electrostatic latent image holding member, and causes the developer scattered when the developer is supplied to adhere to a surface thereof to prevent scatter to the outside, and scraping means for scraping the developer adhering to the scatter preventing member are used to prevent the toner scatter.

Patent Document 3 (Japanese Patent Application Laid-Open No. 2005-242194) proposes a method in which in the two-component developing method, a collecting roller is provided in a housing opening portion of a developing apparatus to collect scattered toner, and the toner is peeled from the collecting roller to return the same to the developing apparatus.

In Patent Document 4 (Japanese Patent Application Laid-Open No. H11-174792), there is provided an image forming apparatus having control means for changing a bias to be applied to the collecting roller in accordance with an formed image ratio, and if the image ratio is less than 5%, the control means sets a bias obtained by superimposing a DC voltage of the same polarity as normal charge polarity of the developer on an AC voltage as the bias applied to the collecting roller, if it is 5 to 15%, sets only an AC bias, and if it exceeds 15%, sets a bias obtained by superimposing a DC voltage of reverse polarity of the normal charge polarity of the developer on an AC voltage.

However, since the toner scatter amount varies in accordance with the toner replenishment amount, in the method by Patent Document 2, at all times, only a certain amount can be collected. Particularly in the touchdown developing method, the scattered toner may affect the toner thin layer on the developing roller, thereby causing image disturbance, and thus, the toner scatter needs to be further suppressed.

Moreover, in the touchdown developing method, since the toner density of the two-component developer is high, and the fluidity of the developer is unsatisfactory, when the magnetic brush is collected in a two-component developer containing part, the developer is sequentially collected and pressed and compressed, so that air has nowhere to go and the toner is discharged outside together with the air, which easily causes the toner scatter.

Furthermore, in the touchdown method, since when the formed image ratio is low, the toner remains on a sleeve of the developing roller, in the method of Patent Document 2, conversely, the toner on the developing roller may be charged up, thereby increasing the toner scatter amount.

In the touchdown developing method, in the case where a printing ratio (image ratio) is low, for example, when it is less than 5%, much undeveloped toner remains on the developing roller, which is collected by the two-component developer composed of at least the carrier and the toner held on the magnetic roller, and is collected into the two-component developer containing part inside of the developing apparatus together with the two-component developer on the magnetic roller. Accordingly, since the amount of the collected toner is large and thus the toner amount in the collected two-component developer is also large, the toner scatter easily occurs when the two-component developer on the magnetic roller is collected into the two-component developer containing part.

In Patent Document 3, when the toner is peeled from the collecting roller, which collected the scattered toner, to return the same to the developing apparatus, a channel to return the toner through needs to be separately provided, which disadvantageously makes the apparatus larger.

In Patent Document 4, even if the above-described constitution is employed, the toner scatter may not be able to be suppressed. Particularly, in a high-speed machine employing the touchdown developing method and having a drum linear velocity of 180 mm/sec or more, the system in which in order to suppress deterioration of the developer, the total amount of the developer is increased may easily cause the toner scatter. The drum linear velocity of 180 mm/sec corresponds to about 40 sheets/min, that of 250 mm/sec corresponds to about 50 sheets/min, and that of 340 mm/sec corresponds to about 60 sheets/min in A4 size in the lateral direction.

Moreover, in the touchdown developing method, means for stabilizing a toner layer thickness on the toner holding body in order to stabilize developability from the toner holding body onto a photoreceptor drum has been known. This compensates for charge characteristics of the toner changed by the deterioration in the two-component developer and the like by varying a potential difference ΔV between the toner holding body and the two-component developer holding body, and stably keeps the toner thin layer thickness on the toner holding body. However, this is control in which the potential difference ΔV is varied in accordance with the toner charge amount in the two-component developer, and if the toner charge amount is decreased, the toner layer thickness on the toner holding body becomes large, and thus, the potential difference ΔV needs to be reduced for returning the toner layer thickness on the toner holding body to the original thickness. However, since this varies the potential difference ΔV in a direction in which it is hard for the toner to move from the magnetic brush formed on the magnetic roller to the toner holding body, the two-component developer is collected into the two-component developer containing part while leaving much toner that does not contribute to the toner thin layer formation in the magnetic brush on the magnetic roller, thereby resulting in a state where the toner scatter more easily occurs. That is, since the difference in toner charge amount makes the potential difference ΔV differ, and in turn this difference in potential difference ΔV makes the scatter toner amount differ, there is a problem in that in the case where collecting power of the collecting roller is set to be constant, the toner scatter cannot be suppressed.

SUMMARY OF THE INVENTION

An object of the present invention is to provide an image forming apparatus and an image forming method that, in a touchdown developing method, can suppress the occurrence of toner scatter, particularly scattered toner by difference in toner charge amount, difference in printing ratio, or difference in toner replenishment amount to maintain stable development characteristics over a long period of time, and can provide a stable image.

A first image forming apparatus and a first image forming method of the present invention for achieving the above-described object have the following constitutions.

(1) The first image forming apparatus is an apparatus in which a two-component developer holding body that has a magnetic member arranged thereinside and magnetically holds a developer made of a carrier and a toner, and a toner holding body that transports the toner from the two-component developer holding body and holds a toner thin layer on a surface thereof are at least provided inside of a housing, and a developing bias is applied to the toner holding body and/or the two-component developer holding body to perform development of an electrostatic latent image formed on an electrostatic latent image holding body surface. In this image forming apparatus, a toner collecting roller that collects scattered toner suspended in the vicinity of the toner holding body and the two-component developer holding body is arranged on the downstream side in a rotational direction of the two-component developer holding body from a closest position of the two-component developer holding body and the toner holding body, and between the two-component developer holding body and the housing wall. Furthermore, bias means that applies a bias voltage for collecting the scattered toner to the toner collecting roller, and image density sensing means for sensing a density of a toner image developed on the electrostatic latent image holding body surface or a toner image on a transfer body onto which the toner image developed on the electrostatic latent image holding body surface is transferred to control the bias voltage are provided.

(2) The image forming apparatus may be further provided with surface potential sensing means that senses a surface potential of the toner holding body for controlling the bias voltage.

(3) Preferably, a circumferential velocity of the electrostatic latent image holding body may be 180 mm/sec or more.

(4) The first image forming method is a method in which using a two-component developer holding body that has a magnetic member arranged thereinside and magnetically holds a developer made of a carrier and a toner, and a toner holding body that transports the toner from the two-component developer holding body and holds a toner thin layer on a surface thereof, which are provided inside of a housing, a developing bias is applied to the toner holding body and/or the two-component developer holding body to perform development of an electrostatic latent image formed on an electrostatic latent image holding body surface. In this image forming method, a toner collecting roller that collects scattered toner suspended in the vicinity of the toner holding body and the two-component developer holding body is arranged on the downstream side in a rotational direction of the two-component developer holding body from a closest position of the two-component developer holding body and the toner holding body, and between the two-component developer holding body and the housing wall, and a bias voltage applied to the toner collecting roller by bias means for collecting the scattered toner is controlled using a sensing result obtained by image density sensing means for sensing a density of a toner image developed on the electrostatic latent image holding body surface or a toner image on a transfer body onto which the toner image developed on the electrostatic latent image holding body surface is transferred.

(5) In the image forming method, preferably, in order to keep a toner thin layer thickness on the toner holding body substantially constant based on the toner density sensed by the image density sensing means, a bias difference ΔV between the two-component developer holding body and the toner holding body may be set, and the bias voltage applied to the toner collecting roller may be controlled in accordance with the set bias difference ΔV.

(6) In the image forming method, preferably, if the toner density is higher than a predetermined density, the bias difference ΔV may be changed, and then an image patch may be again formed and the density of the image patch may be sensed by the image density sensing means to repeatedly change the bias difference ΔV until the density reaches the predetermined density.

(7) In the image forming method, preferably, if the bias difference ΔV when the density reaches the predetermined density is below a predetermined threshold, the bias voltage may be applied to the toner collecting roller.

(8) In the image forming method, preferably, based on a surface potential of the toner holding body sensed by surface potential sensing means that senses the surface potential of the toner holding body for controlling the bias voltage, and the toner density sensed by the image density sensing means, a toner charge amount of the toner thin layer on the toner holding body may be calculated, and based on the calculated result, the bias voltage applied to the toner collecting roller may be controlled.

According to the first image forming apparatus and the first image forming method, since the toner collecting roller is arranged on the downstream side in the rotational direction of the two-component developer holding body from the closest position of the two-component developer holding body and the toner holding body, and between the two-component developer holding body and the housing wall, the scattered toner can be caused to adhere to the toner collecting roller and captured to be collected. Furthermore, since the toner collecting roller is provided with the bias means that applies the bias voltage for collecting the scattered toner, and the bias voltage is controlled by the bias means in accordance with the toner charge amount associated with the scattered toner amount, the scattered toner varying in the amount of emergence can be more effectively collected onto the toner collecting roller by controlling the thickness of the toner layer on the toner holding body specific to the touchdown development. As a result, the toner scatter can be suppressed, thereby resulting in image quality stable for a long time.

A second image forming apparatus and a second image forming method of the present invention have the following constitutions.

(9) The second image forming apparatus is an apparatus in which a two-component developer holding body that has a magnetic member arranged thereinside and magnetically holds a developer made of a carrier and a toner, and a toner holding body that transports the toner from the two-component developer holding body and holds a toner thin layer on a surface thereof are at least provided inside of a housing, and a developing bias is applied to the toner holding body and/or the two-component developer holding body to perform development of an electrostatic latent image formed on an electrostatic latent image holding body surface. In this image forming apparatus, a toner collecting roller that collects scattered toner suspended in the vicinity of the toner holding body and the two-component developer holding body is arranged on the downstream side in a rotational direction of the two-component developer holding body from a closest position of the two-component developer holding body and the toner holding body, and between the two-component developer holding body and the housing wall. Furthermore, bias means that applies a bias voltage for collecting the scattered toner to the toner collecting roller, and control means for controlling the bias voltage in accordance with a printing ratio are provided.

(10) Preferably, a circumferential velocity of the electrostatic latent image holding body may be 180 mm/sec or more.

(11) The second image forming method is a method in which using a two-component developer holding body that has a magnetic member arranged thereinside and magnetically holds a developer made of a carrier and a toner, and a toner holding body that transports the toner from the two-component developer holding body and holds a toner thin layer on a surface thereof, which are provided inside of a housing, a developing bias is applied to the toner holding body and/or the two-component developer holding body to perform development of an electrostatic latent image formed on an electrostatic latent image holding body surface. In this image forming method, preferably, a toner collecting roller that collects scattered toner suspended in the vicinity of the toner holding body and the two-component developer holding body may be arranged on the downstream side in a rotational direction of the two-component developer holding body from a closest position of the two-component developer holding body and the toner holding body, and between the two-component developer holding body and the housing wall, and a printing ratio may be compared with a predetermined threshold range, and in accordance with the comparison result, a bias voltage applied to the toner collecting roller by bias means for collecting the scattered toner may be an AC voltage or a DC voltage, or a bias voltage obtained by superimposing a DC voltage of reverse polarity or same polarity with respect to a normal charge characteristic of the developer on an AC voltage.

(12) Preferably, if the printing ratio is above an upper limit value of the threshold range, a bias voltage obtained by superimposing a DC voltage of the same polarity as the normal charge characteristic of the developer on an AC voltage may be applied, if the printing ratio is within the threshold range, only an AC voltage may be applied, and if the printing ratio is below a lower limit of the threshold range, a bias voltage obtained by superimposing a DC voltage of the reverse polarity to the normal charge characteristic of the developer on an AC voltage may be applied.

(13) Preferably, the upper limit value of the threshold range may be 7 to 20%, and the lower limit value of the threshold range may be 1 to 10%.

According to the second image forming apparatus and the second image forming method, the scattered toner can be caused to adhere to the toner collecting roller and captured to be collected. Furthermore, the toner collecting roller is provided with the bias means that applies the bias voltage for collecting the scattered toner, and the bias voltage is controlled by the control means in accordance with the printing ratio, the scattered toner varying in the amount of emergence in accordance with the printing ratio can be more efficiently collected onto the toner collecting roller. As a result, the toner scatter can be suppressed, thereby resulting in image quality stable for a long time.

A third image forming apparatus and a third image forming method of the present invention have the following constitutions.

(14) The third imaging forming apparatus is an apparatus in which a two-component developer holding body that has a magnetic member arranged thereinside and magnetically holds a developer made of a carrier and a toner, and a toner holding body that transports the toner from the two-component developer holding body and holds a toner thin layer on a surface thereof are at least provided inside of a housing, and a developing bias is applied to the toner holding body and/or the two-component developer holding body to perform development of an electrostatic latent image formed on an electrostatic latent image holding body surface. In this image forming apparatus, toner replenishing means that replenishes the toner into the housing is provided, an electrode member that collects scattered toner suspended in the vicinity of the toner holding body and the two-component developer holding body is arranged on the downstream side in a rotational direction of the two-component developer holding body from a closest position of the two-component developer holding body and the toner holding body, and between the two-component developer holding body and the housing wall, and further bias means that applies a bias voltage for collecting the scattered toner to the electrode member, and control means for controlling the bias voltage in accordance with a toner replenishment amount of the toner replenishing means are provided.

(15) Preferably, the toner replenishing means may be provided with a toner amount detecting sensor to control the toner replenishment amount in accordance with an output value of the toner amount detecting sensor.

(16) Preferably, the electrode member may be a rotating roller.

(17) Preferably, a circumferential velocity of the electrostatic latent image holding body may be 180 mm/sec or more.

(18) Preferably, the control of the toner replenishment amount may be performed by turning ON/OFF the drive of a toner replenishing roller provided in the toner replenishing means for a predetermined time in accordance with the output value of the toner amount detecting sensor.

(19) Preferably, if the toner replenishment amount exceeds a predetermined value, a DC voltage lower than a DC voltage applied to the two-component developer holding body may be applied to the electrode member.

According to the third image forming apparatus and the third image forming method of the present invention, since the electrode member that collects the scattered toner is arranged on the downstream side in the rotational direction of the two-component developer holding body from the closest position of the two-component developer holding body and the toner holding body, and between the two-component developer holding body and the housing wall, the bias means that applies the bias voltage for collecting the scattered toner to the electrode member is provided, and the bias voltage is controlled by the bias means based on the toner replenishment amount. Thereby, the amount of emergence of the scattered toner varying in accordance with the toner replenishment amount can be more effectively collected onto the electrode member. As a result, the toner scatter can be suppressed, thereby resulting in image quality stable for a long time.

DETAILED DESCRIPTION OF THE PREFERRED EMBODIMENTS

First Embodiment

Figure 1:
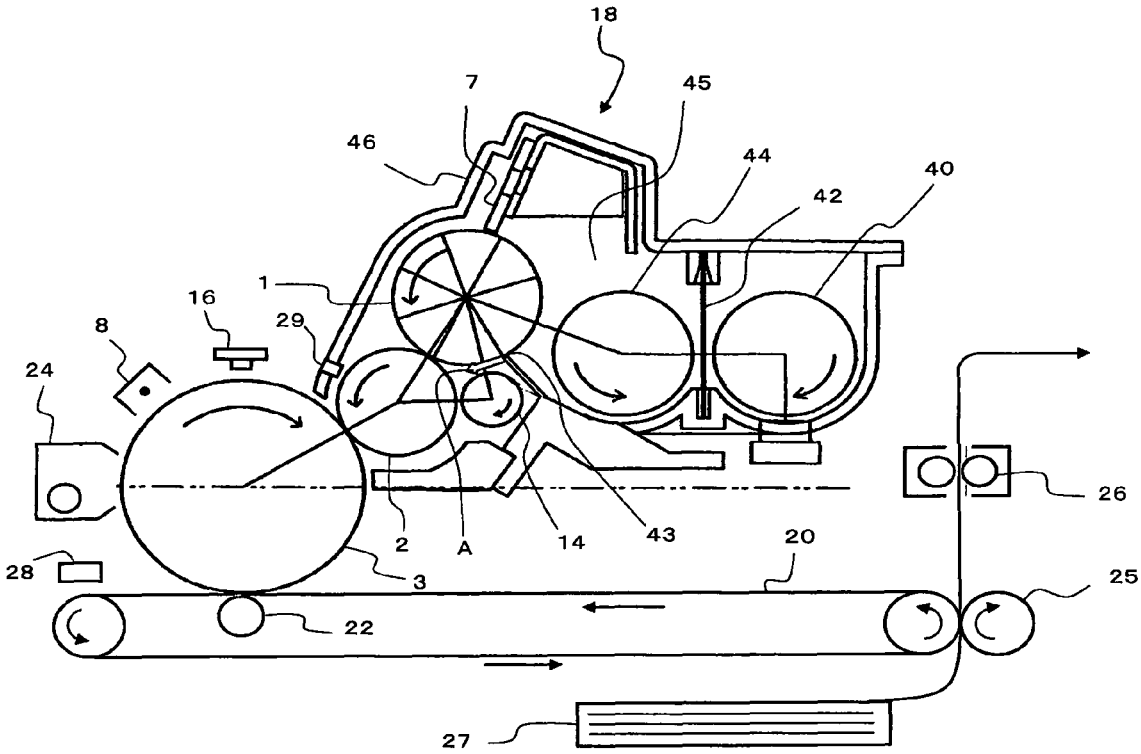
FIG. 1 is an explanatory diagram showing a schematic configuration of a touchdown developing type image forming apparatus according to a first embodiment of the present invention.
Figure 2:
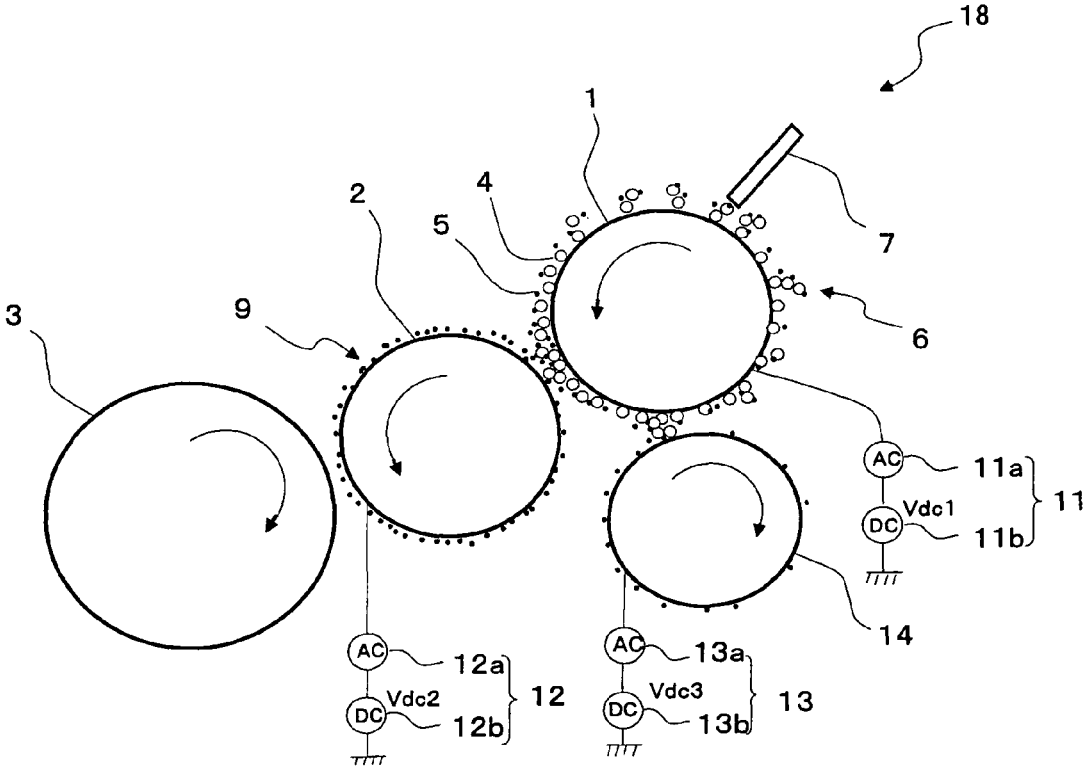
FIG. 2 is a schematic configuration diagram showing part of developing means of FIG. 1.
Figure 3:
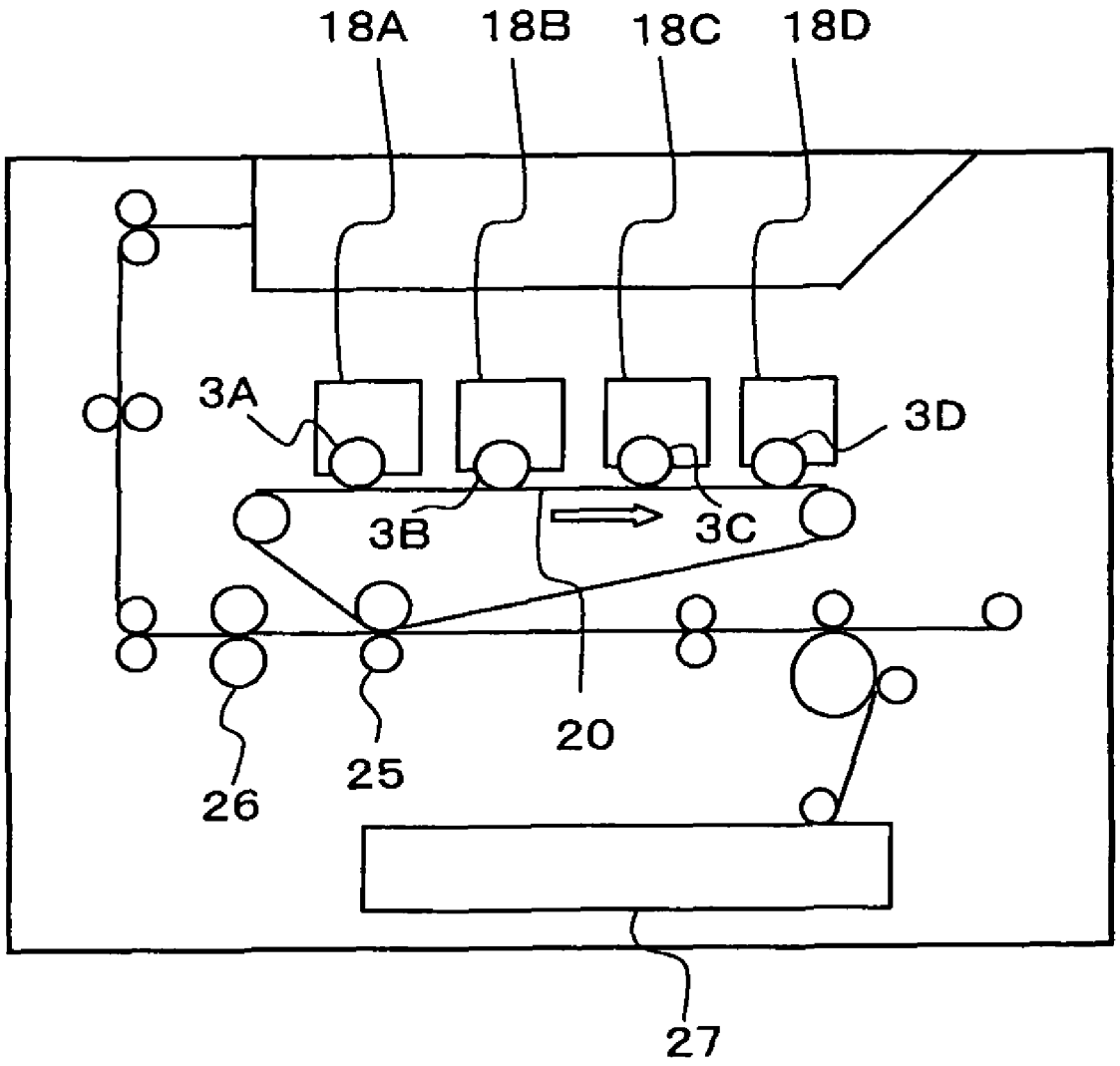
FIG. 3 is a schematic configuration diagram showing one example of a tandem-type color image forming apparatus using the developing means shown in FIG. 1.

Hereinafter, a first embodiment of the present invention will be described in detail based on the drawings. FIG. 1 is an explanatory diagram showing a schematic configuration of a touchdown developing type image forming apparatus according to the first embodiment. FIG. 2 is a schematic configuration diagram showing part of developing means in FIG. 1. FIG. 3 is a schematic configuration diagram showing one example of a tandem-type color image forming apparatus using the developing means shown in FIG. 1.

(Image Forming Apparatus)

An image forming apparatus of the first embodiment is an image forming apparatus by a so-called touchdown developing method, in which using a two-component developer composed of a magnetic carrier 4 and a toner 5, a toner thin layer 9 is formed on a developing roller 2 by the two-component developer held on a magnetic roller 1 to develop an electrostatic latent image formed on a photoreceptor 3 (electrostatic latent image holding body). As shown in FIG. 1, the image forming apparatus is provided with the photoreceptor 3, and around this photoreceptor 3, charging means 8, exposing means 16, developing means 18, primary transfer means 22, secondary transfer means 25, fixing means 26, cleaning means 24 and the like are arranged.

The image formation by the image forming apparatus is performed as follows. A surface of the photoreceptor 3 is uniformly charged by the charging means 8, and this charged surface is exposed by the exposing means 16 to form an electrostatic latent image. The resultant electrostatic latent image is developed as a toner image by causing the toner 5 to adhere to the electrostatic latent image from the developing means 18. This toner image is transferred onto an intermediate transfer body (intermediate transfer belt) 20 from the photoreceptor 3 by the primary transfer roller 22 as the first transfer means. After the toner images of a plurality of colors are superposed and transferred on the intermediate transfer body 20, the toner image is transferred to a transferred material fed to a secondary transfer position from a paper-feed cassette 27 by the secondary transfer roller 25 as the secondary transfer means. This transferred material is fed to the fixing roller 26 as the fixing means, where the toner image is fixed on the transferred material, and then, is discharged to a paper discharging tray (not shown), for example. Undeveloped toner remaining on the photoreceptor 3 surface after transfer is removed by the cleaning means 24.

As the photoreceptor 3 are cited an inorganic photoreceptor such as selenium and amorphous silicon, an organic photoreceptor (OPC) in which a single layer or multilayer photosensitive layer containing a charge generating agent, a charge transporting agent, binder resin and the like is formed on a conductive substrate, and soon. As the charging means 8 are cited a scorotron method, a charging roller, a charging brush and the like. For the exposing means 16, an LED, a semiconductor laser and the like are cited as exposure light. Moreover, as the cleaning means 24 are cited, for example, a doctor blade method and the like. For each of the foregoing, publicly-known ones can be used.

The developing means 18 is made of the sleeve-like magnetic roller 1 (two-component developer holding body) inside of which a plurality of magnetic members are provided so as to be fixed, and that rotates around outer circumferential portions of the magnetic members, the sleeve-like developing roller 2 (toner holding body) inside of which a magnetic member of different polarity from that of the magnetic roller 1 is provided so as to be fixed, and that rotates around an outer circumferential portion of the magnetic member, a regulatory blade 7 for keeping constant a height of magnetic brush 6 formed on the magnetic roller 1 by a magnetic field, which is formed by magnetic attractions of the different magnetic polarities of the magnetic roller 1 and the developing roller 2, and a toner collecting roller 14 (hereinafter, also referred to as a collecting roller) for collecting the scattered toner. Furthermore, the developing means 18 is equipped with an alternating current (AC) bias electric source 11*a* and a direct current (DC: Vdc1) bias electric source 11*b* to be applied to the magnetic roller 1, an alternating current (AC) bias electric source 12*a* and a direct current (DC: Vdc2) bias electric source 12*b* to be applied to the developing roller 2, and an alternating current (AC) bias electric source 13*a* and a direct current (DC: Vdc3) bias electric source 13*b* to be applied to the toner collecting roller 14. Moreover, it is equipped with an image density sensing means 28 for sensing a density of the toner image on the photoreceptor 3 or the intermediate transfer body 20 according to the present invention.

Moreover, the image forming apparatus has a toner container (not shown) in which the toner 5 is stored, a stirring screw 40 and a stirring screw 44 that stir the toner 5 supplied from the toner container to a two-component developer containing part 45, which contains a two-component developer, together with the carrier 4 to charge the same. Both the stirring screws 40, 44 communicate with each other at both end portions of a dividing plate 42, and supply, to the magnetic roller 1, part of the two-component developer supplied from the stirring screw 40 to the stirring screw 44 through the one end side. On the stirring screw 44 side, the remaining two-component developer is circulated to the stirring screw 40 through the other end side of the dividing plate 42. Inside of a housing 46 of the image forming apparatus, the magnetic roller 1, the developing roller 2, the stirring screw 40 and the stirring screw 44 are contained.

The above-described image forming apparatus, as shown in FIG. 3, can be preferably used for a tandem-type (indirect transfer tandem-type) color image forming apparatus, in which four photoreceptors 3A, 3B, 3C, 3D are arrayed on the intermediate transfer body 20. Using the above-described developing means 18, electrostatic latent images on the photoreceptors 3A, 3B, 3C, 3D are visualized by developing apparatuses 18A, 18B, 18C, 18D containing respective toners of magenta, cyan, yellow and black to form toner images, respectively. On a surface of the intermediate transfer body 20, the toner images visualized on the photoreceptors 3A, 3B, 3C, 3D are transferred in order from the photoreceptor 3A on the upstream side. This full color image transferred on the intermediate transfer body 20 is transferred by the secondary transfer roller 25 onto the transferred body (paper or the like) which is fed from the paper-feed cassette 27, and subsequently, after it is fixed by the fixing roller 26, this transferred body is discharged.

Here, with the scattered toner, a major source of emergence thereof is as follows; when the two-component developer on the magnetic roller 1 is collected by the two-component developer containing part 45, the magnetic brush 6 is compressed, by which air between the magnetic brushes 6 cannot enter the two-component developer containing part 45 and is beaten off, and thus the toner 5 is also ejected from a two-component developer collecting part 43 together with the air. In the touchdown developing method, the magnetic roller 1 supplies the toner 5 onto the developing roller 2 near a closest position to the developing roller 2 to form the toner thin layer 9, and the undeveloped toner on the developing roller 2 that did not contribute to the development of the electrostatic latent image is peeled and collected. This undeveloped toner has a smaller adhesive property to the carrier 4 (than the adhesive property between the toner 5 and the carrier 4 in the two-component developer when the toner thin layer 9 is formed). Moreover, since the touchdown developing method has a constitution in which the toner density in the two-component developer is kept higher than that in the normal two-component developing method, thereby making the fluidity of the two-component lower, so that it is harder for the air between the magnetic brushes 6 to enter the two-component developing containing part 45, and consequently, the toner scatter easily occurs.

Moreover, although as the process linear velocity becomes higher, the toner 5 necessary for developing more electrostatic latent images for a short time needs to be fed to the developing roller 2, the time necessary for forming the toner layer 9 becomes shorter, and thus measures of increasing the toner density in the two-component developer and the like become necessary. That is, after the toner layer 9 is formed, the toner density of the two-component developer collected into the two-component developer containing part 45 becomes higher than that at the time of low velocity. Moreover, since the peeling time of the undeveloped toner on the developing roller 2 becomes shorter, and the toner density of the two-component developer collected into the two-component developer containing part 45 is higher, the peeling becomes harder. Furthermore, a state where the toner scatter easily occurs is produced, and the scattered toner may adhere to the developing roller 2, thereby growing the collected toner amount, which is likely to increase the toner scatter.

Moreover, in the touchdown developing method, there is a method in which in order to stabilize the developability from the developing roller 2 to the photoreceptor 3, by varying the potential difference $\Delta V$ between the developing roller 2 and the magnetic roller 1, the charge characteristics of the toner 5 varying by deterioration of the two-component developer and the like are compensated for to keep stable the layer thickness of the toner thin layer 9 on the developing layer 2. That is, the developability and the transfer property differ in accordance with the toner charge amount, and for example, when the toner charge amount becomes higher, the toner thin layer 9 becomes thinner, and further the developing efficiency and transfer efficiency tend to decrease. Therefore, the potential difference $\Delta V$ between the developing roller 2 and the magnetic roller 1 is controlled to keep the toner amount of the toner thin layer 9 stable, and also the bias voltage applied to the developing roller 2 is controlled so that the toner density on the photoreceptor 3 or the intermediate transfer body 20 (e.g., toner density of an image patch) can be kept stable. For example, when the toner density of the image patch rises, the toner charge amount may often decrease. In this case, the toner thin layer 9 on the developing roller 2 becomes thicker, and the necessary toner amount becomes superfluous. Therefore, the potential difference ΔV between the developing roller 2 and the magnetic roller 1 is adjusted and controlled so that the toner layer thickness 9 on the developing roller 2 becomes substantially the same as that in an normal state. Furthermore, adjusting the bias voltage applied to the developing roller 2 allows the toner density of the image patch to be maintained stably. However, at this time, since the potential difference ΔV is varied in the direction in which it is hard for the toner 5 to move from the magnetic brush 6 formed on the magnetic roller 1 to the developing roller 2, part of the toner 5, which should move onto the developing roller 2 and form the toner thin layer 9 before the variation, will be collected into the two-component developer containing part 45 while remaining in the magnetic brush 6 on the magnetic roller 1 as the low charged toner 5 without contributing to the toner thin layer 9 formation. This produces a state where much low charged toner 5 weak in adherence to the carrier 4 exists, which causes the toner scatter to easily occur.

Accordingly, such a bias voltage that grows the collecting power of the toner collecting roller 14 for the scattered toner is required to be set.

That is, since the scattered toner amount differs in accordance with difference in the above-described ΔV, which corrects the toner thin layer thickness on the developing roller 2, if the bias voltage applied to the collecting roller 14 is kept constant, the toner scatter cannot be suppressed. The scattered toner causes various poor images, improper operations and the like, and particularly, the scattered toner adheres to the surface of the developing roller 2, thereby easily causing a ghost phenomenon arising from poor peeling, which is one of factors preventing favorable image formation.

(Toner Collecting Roller)

The toner collecting roller 14 is intended to capture the scattered toner and return the same to the magnetic roller 1, and as shown in FIG. 1, in the arrangement configuration of the photoreceptor 3, the developing roller 2, the magnetic roller 1, and the stirring screws 40, 44, it is disposed on the downstream side in a rotational direction of the magnetic roller 1 from the closest position of the magnetic roller 1 and the developing roller 2, being opposed to the magnetic roller 1 so as to shut a clearance between the magnetic roller 1 and a housing 46 wall.

With the above-described configuration, the scattered toner suspended in the vicinity of the developing roller 2 and the magnetic roller 1, and the scattered toner that moves in an arrow direction A in FIG. 1 through the clearance on the lower side of the magnetic roller 1 and scatters inside of the image forming apparatus can be caused to adhere to a toner collecting roller 14 surface by intermolecular force, electrostatic force and the like, and be captured.

The collecting roller 14 may preferably rotate in a circumferential direction. This allows the scattered toner adhering to the surface of the collecting roller 14 to come into contact with the magnetic brush 6 formed on the magnetic roller 1 and be peeled, thereby being returned to the magnetic roller 1 side.

A rotational direction of the collecting roller 14 may be the same direction as the rotational direction of the magnetic roller 1 (trail rotation with respect to the magnetic roller 1) in the opposed position, or may be a reverse direction (counter rotation). The trail rotation is preferable. The trail rotation makes it easier to immediately collect the toner on the collecting roller 14 onto the magnetic roller 1, and reduces stress applied to the collected toner, which can prevent deterioration of the collected toner.

A circumferential velocity of the collecting roller 14 is preferably 10 to 100 mm/sec, more preferably 20 to 70 mm/sec. If the circumferential velocity of the collecting roller 14 is less than 10 mm/sec, the collecting amount of the scattered toner is not favorable because the number of rotations is too small. Moreover, if it exceeds 100 mm/sec, the collectability of the scattered toner is decreased and when the adhering toner is peeled by the magnetic brush 6, there is possibility that the toner again scatters, which is not favorable.

For a material of a rotating sleeve of the collecting roller 14, metal such as aluminum and stainless steel can be used. It is preferable that aluminum subjected to alumite treatment having a large specific surface area is used in view of adhesive property of the scattered toner, or/and that its surface is covered with fluorine resin or the like in view of electrostatic adhesive property (in the case where the charge characteristic of the toner is positive).

To the toner collecting roller 14 is applied a bias voltage by bias means 13 for collecting the scattered toner, and the bias voltage is controlled using the image density sensing means 28. That is, the control of the bias voltage is such that the toner density of the toner image developed on the photoreceptor 3 is sensed by the image density sensing means 28, the bias difference ΔV between the magnetic roller 1 and the developing roller 2 is controlled in accordance with the toner density, and the bias voltage is applied to the toner collecting roller 14 in accordance with the bias difference ΔV.

As described above, in the control of the bias voltage, when the layer thickness is controlled so as to keep the thickness of the toner thin layer 9 on the developing roller 2 constant to match the image density, i.e. when the bias difference ΔV between the magnetic roller 1 and the developing roller 2 is controlled, the bias applied to the collecting roller 14 is changed at predetermined timing and during non-image formation. This is based on a finding that when the toner charge amount is low, a low value is calculated as ΔV, and if the toner charge amount is high, a high value is calculated as ΔV. The predetermined timing can be set using a number of printed sheets, dot counts, a development driving time and the like. Alternatively, calibration operation time when gradation adjustment and density adjustment are performed may be employed.

Since if the toner charge amount is low, ΔV is reduced, low charged toner 5 remains in the magnetic brush 6 on the magnetic roller 1 without contributing to the formation of the toner thin layer 9, and the remaining toner 5 has small electrostatic attraction with respect to the carrier 4, which makes it easier that the toner 5 comes off from a carrier 4 surface. This will increase the amount of scattered toner. Accordingly, if ΔV is low, by increasing the bias applied to the collecting roller 14 in a direction that attracts the toner 5, much scattered toner can be collected.

Figure 4:
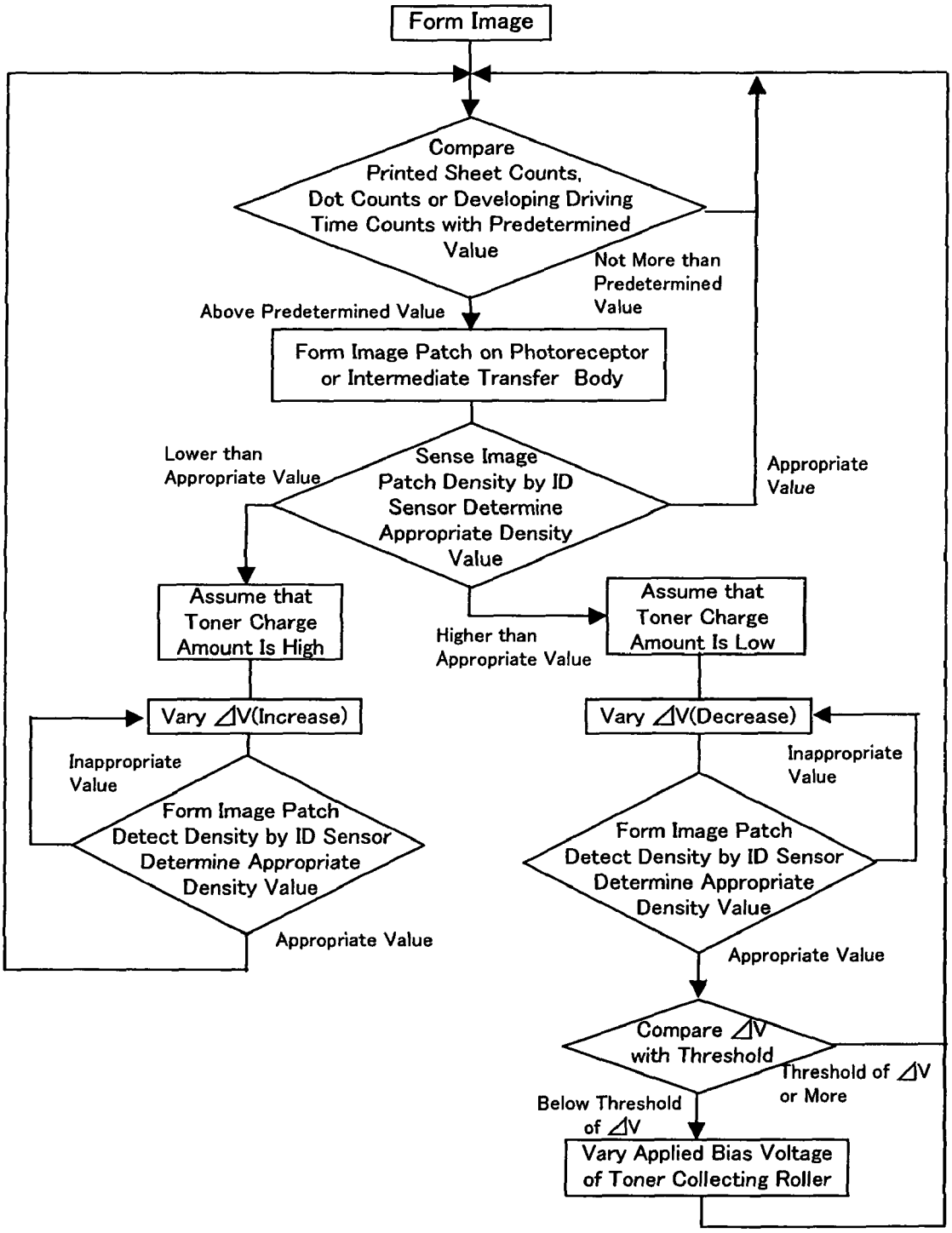
FIG. 4 is a flowchart showing one example of the control of a bias voltage applied to a toner collecting roller in the first embodiment of the present invention.
Figure 6:
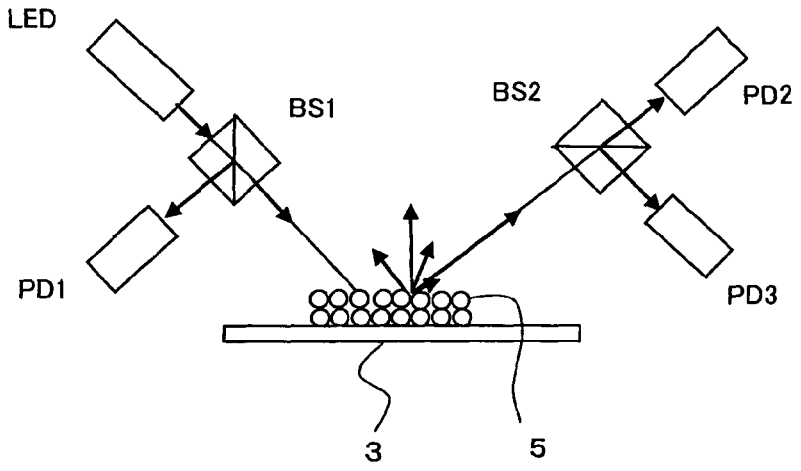
FIG. 6 is a diagram explaining one example of a method of sensing a toner density by toner density sensing means in the first embodiment of the present invention.

In FIG. 4, one example of the control of the bias voltage applied to the collecting roller 14 is shown in a flowchart diagram. The density sensor 28 (hereinafter, referred to as an ID sensor) is installed on the photoreceptor 3 or the intermediate transfer body 20 as the image density sensing means. The ID sensor 28 senses the toner image formed on the photoreceptor 3, for example (e.g., reference patch image), as shown in FIG. 6. As the ID sensor 28, a reflective density sensor can be used. FIG. 6 shows a schematic diagram of the reflective density sensor. The reflective density sensor is constituted such that light irradiated from an LED passes through a BS (Beam splitter) 1 to be polarized in one direction and is irradiated to a toner surface, while the light polarized in the other direction is monitored by a PD1 to keep the amount of light constant by a feedback circuit. The light reflected from the toner surface becomes scattered light, and is again divided into two polarization components in a BS2 to enter PD2, and PD3, respectively. The toner amount is sensed from the ratio.

If the development driving time exceeds a predetermined driving time in the image formation, an image patch is formed on the photoreceptor 3 surface. The toner density of the image patch is sensed by the ID sensor 28. The forming timing of the image patch may be preferably performed every 5 to 20 minutes of the development driving time. Referring to a data table (relationships between the toner density and the toner thin layer thickness) provided in advance, if the obtained toner density is within a predetermined range, the toner layer thickness is determined to be appropriate, and the image formation is continued. The appropriate range of the toner layer thickness is 7 to 18 μm. Since the appropriate range of the toner layer thickness differs in accordance with color developability, contrast ratio, gloss and the like of the toner 5, the appropriate range may be set in accordance with these. If the toner density is higher than the appropriate value, the toner layer thickness is determined to be higher than the predetermined range from the table, that is, the toner charge amount is determined to be low, and ΔV is reduced. ΔV at this time is determined based on a data table on relationships between the toner layer thickness and ΔV provided in advance.

Next, ΔV at this time is compared with a predetermined threshold (referring to a data table provided in advance), and if it is the predetermined threshold or higher, an image formation is continued. If ΔV is below the predetermined threshold, the bias voltage Vdc3 of the collecting roller 14 is increased in the direction that attracts the scattered toner. Thereafter, the image formation is continued.

As shown in FIG. 4, if the toner density is first determined to be high, with this, ΔV may be varied by a predetermined amount, and then an image patch may be formed again to sense the toner density by the ID sensor 28. This may be repeated until a predetermined toner density is obtained to determine ΔV, and ΔV at this time may be compared with the predetermined threshold.

When the toner density is first determined to be high, with this, a plurality of image patches with ΔV varied may be formed, and compared with the data table (relationships between the toner density and the toner layer thickness) provided in advance to determine ΔV. On the other hand, if the toner density is first determined to be low, similarly, with this, ΔV may be varied by the predetermined amount, and then an image patch is again formed to sense the toner density by the ID sensor 28. This may be repeated until the predetermined toner density is obtained to set an appropriate ΔV, and the image formation is continued.

As a parameter of the formation timing of the image patch, in addition to the development driving time, the number of printed sheets and the dot counts can be used. In the above-described control of ΔV, more specifically, for example if ΔV is less than the predetermined threshold (e.g., 150 to 200 V), a potential of the collecting roller 14 is set to be lower than a potential of the magnetic roller 1 (e.g., the DC voltage Vdc1=300 V). That is, the DC voltage Vdc3 of the collecting roller 14 is set to 100V. Moreover, if ΔV is the predetermined threshold or more, substantially the same potential as that of the magnetic roller 1 is set. Although the above-described ΔV is limited by the characteristics of the developer, ΔV can be varied to be controlled in accordance with the extent of the scatter of the toner as long as it is within the limited range. Moreover, a potential difference from the magnetic roller 1 may be varied in a stepwise fashion corresponding to ΔV. For example, if the threshold of ΔV is 190 V and ΔV is 180 V, Vdc3 of the collecting roller 14 may be set to 100 V, and if ΔV is 170 V, Vdc3 of the collecting roller 14 may be 80 V, so that the address to suit the scatter level of the toner is possible. In the foregoing, the method for collecting the toner 5 to the collecting roller 14 side, employing the constitution in which only the DC voltage difference is used in the case where ΔV is 190 V or less has been described. However, a constitution may be employed in which at least one of an alternating DUTY ratio, Vpp and frequency is used to collect the toner 5 to the collecting roller 14 side.

(Developing Method)

FIG. 2 schematically shows part of the developing means according to the present invention. Hereinafter, a developing method is described.

The magnetic brush 6 made of the carrier 4 (magnetic particles) magnetically bound by fixing magnets included in the magnetic roller 1 and the toner 5 charged and retained with respect to its surface turns on the magnetic roller 1 surface to be fed to the developing roller 2. For the surface of the magnetic roller 1, one subjected to blast treatment or groove processing is used to thereby feed the magnetic brush 6 more smoothly.

As shown in FIG. 2, to the developing roller 2 is applied a developing bias voltage 12 obtained by superimposing the alternating current voltage (AC) 12*a* on the direct current voltage (DC:Vdc2) 12*b*, and to the magnetic roller 1 is applied a developing bias voltage 11 obtained by superimposing the alternating current voltage (AC) 11*a* on the direct current voltage (DC:Vdc1) 11*b*. The magnetic brush 6 is formed on the magnetic roller 1, and the magnetic brush 6 on the magnetic roller 1 is layer-regulated by the regulatory blade 7. The potential difference between the magnetic roller 1 and the developing roller 2 allows only the charged toner 5 of the fed magnetic brush 6 to move to the developing roller 2 and form the toner layer 9. By the toner layer 9 on the developing roller 2, an electrostatic latent image on the photoreceptor 3 is developed.

The DC voltage Vdc is an areal center voltage, and varies when the DUTY ratio is varied. In the present invention, if a duration time when the voltage is applied to the positive polarity side is T1, and a duration time when the voltage is applied to the negative polarity side is T2 in one period of the rectangular AC voltage, the DUTY ratio is represented by DUTY ratio (%)=[T1/(T1+T2)]×100. At this time, a voltage at which areas of a waveform rising on the positive polarity side and a waveform rising on the negative polarity side are equal is referred to as the areal center voltage. A DC voltage may be superimposed as needed, and if the DC voltage is superimposed, Vdc=DC voltage+areal center voltage. Vdc when an AC voltage is not applied is merely a DC voltage.

The electrostatic latent image on the photoreceptor 3 can be formed by charging the surface of the photoreceptor 3 with +250 to 800 V by the charging means 8 and using the exposing means 16. When an OPC (organic photoreceptor) is used, +70 to 220 V is obtained by full exposure, and with an amorphous silicon photoreceptor, a potential after exposure of 10 to 50 V is obtained. For the exposure, either a semiconductor laser or an LED can be used.

After the development is performed as described above, the developing roller 2 having the remaining toner layer becomes closest to the magnetic roller 1 having a developer layer in the opposite position, where the toner layer 9 on the developing roller 2 is scraped by mechanical force by the magnetic brush 6. At the same time, the toner 5 is supplied to the developing roller 2 side from the developer layer on the magnetic roller 1 in accordance with the potential difference (i.e., electric field) formed between the magnetic roller 1 and the developing roller 2.

During the development, as bias conditions, preferably, +300 to 500 V may be applied to the magnetic roller 1 and +100 V to the developing roller 2. For the potential difference for the thin layer formation, 200 to 400 V is appropriate, which may be preferably adjusted by balance with respect to the charge amount of the toner 5. The use of feedback control and the like allow the layer thickness of the toner thin layer 9 to be kept constant to some extent.

As AC conditions, for the magnetic roller 1, the same frequency, and the same period, and reverse phase with respect to the developing roller 2, $V_{P-P}$ (peak AC bias)=0.1 to 2.0 kV, frequency=2 to 4 kHz, Duty ratio=60 to 80% is preferable, and for the developing roller 2, $V_{P-P}$=1.0 to 2.0 kV, frequency=2 to 4 kHz, Duty ratio=20 to 40% is preferable. If $V_{P-P}$ is increased, the thin layer formation is performed instantly, but leak resistance becomes weak, which causes noise to occur. In these respects, increasing insulation property by alumite treatment or the like onto the surfaces of the magnetic roller 1 and the developing roller 2 is preferable because a margin is enlarged. The frequency may be adjusted by the charge amount of the toner 5.

A volume average particle diameter of the toner 5 may be preferably 4.0 to 7.5 μm. If it is less than 4.0 μm, influence of nonelectrostatic adherence becomes large, resulting in decrease in developability and collectability. If it is larger than 7.5 μm, a high-quality image in smoothness and the like is hardly obtained. Moreover, for the charge amount of the toner 5, about 6 to 30 μC/g is preferable. A charge amount lower than this would allow the toner 5 to drift from the magnetic brush 6 and blemish the periphery, while a charge amount higher than this weakens the thin layer formation.

The toner volume average particle diameter can be measured with an aperture diameter of 100 μm (measurement range 2.0 to 60 μm), using a multisizer III (produced by Beckman Coulter, Inc.).

Moreover, the toner charge amount can be measured with a QM meter (MODEL 210HS, produced by TREK Inc.).

For the carrier 4, while publicly known ones can be used, preferably, a ferritic core may be used and its surface may be coated with resin. The coating resin may be well-known ones such as silicon, fluorine-epoxy, fluorine-silicon, polyamide, and polyamideimide. Moreover, a carrier particle diameter (weight average particle diameter) may be preferably 25 to 50 μm. If it is less than 25 μm, retaining force by magnetic attraction becomes weak, and thus carrier flying in which the carrier 4 moves to the developing roller 2 and the collecting roller 14, and the like occur. If it exceeds 50 μm, the density of the magnetic brush 6 is not appropriate, and thus the formation of the toner thin layer 9 is not smooth, and also a specific surface area is small, thereby decreasing the collectability of the toner 5. Furthermore, saturation magnetism of the carrier 4 may be preferably 35 to 90 emu/g. If the saturation magnetism is lower than 35 emu/g, the carrier flying remarkably deteriorates, and if it is higher than 90 emu/g, the density of the magnetic brush 6 is decreased, which leads to disability to form a uniform thin layer.

The saturation magnetism of the carrier 4 can be measured with a magnetic field of 79.6 kA/m (1 kOe), using "VSM-P7" produced by Toei Industry Co., Ltd.

A gap between the magnetic roller 1 and the developing roller 2 may be 200 to 600 μm, preferably 300 to 400 μm. The gap is the most effective factor for instantly forming the thin layer. Its large width reduces the efficiency, thereby causing a problem such as developing ghost. Its narrow width causes a problem in that the magnetic brush 6 passing through a blade gap cannot pass through the gap, so that the toner thin layer 9 is disturbed, and the like.

Moreover, a gap between the magnetic roller 1 and the toner collecting roller 14 is substantially a distance allowing the magnetic brush 6 to come into contact with the collecting roller 14, and may be preferably smaller than the gap between the magnetic roller 1 and the developing roller 2, 150 to 500 μm, more preferably 200 to 300 μm.

Making the distance between the magnetic roller 1 and the collecting roller 14 not more than the distance between the magnetic roller 1 and the developing roller 2 can prevent the scattered toner generated around the magnetic roller 1 from scattering to the developing roller 2 side. Making the gap between the magnetic roller 1 and the collecting roller 14 narrower causes leak, and thus in order to suppress this leak, the insulating property needs to be increased by alumite treatment onto the surface of the collecting roller 14 or the like to give resistance to the surface. In this case, electric resistivity of the collecting roller 14 surface may be preferably $10^7$ to $10^{12}$ Ω·m.

Modification of First Embodiment

Figure 5:
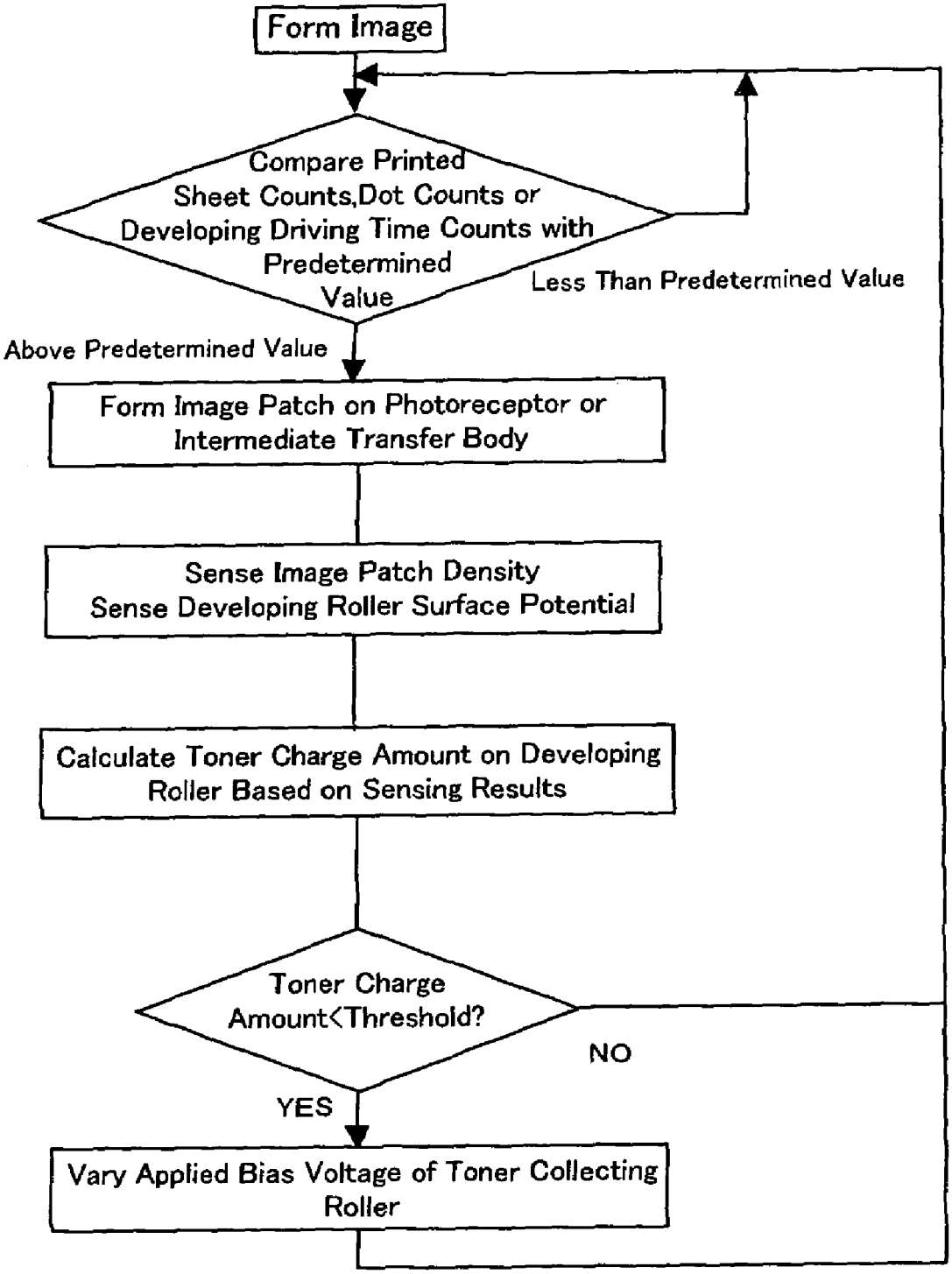
FIG. 5 is a flowchart showing one example of the control of the bias voltage applied to the toner collecting roller in a modification of the first embodiment.

The control of the bias voltage applied to the toner collecting roller 14 by the bias means 13 may be control in accordance with the toner charge amount on the developing roller 2 in place of the control in accordance with ΔV in the first embodiment. However, here, in the control, the toner charge amount on the developing roller 2 is a toner charge amount on the developing roller 2 calculated from a surface potential of the developing roller 2 and a toner density of an image patch. Therefore, in the present embodiment, surface potential sensing means 29 for sensing the surface potential of the developing roller 2 is provided, and as the surface potential sensing means 29, a surface potential sensing sensor is used. FIG. 5 shows one example of the control of the bias voltage applied to the collecting roller 14 in the present embodiment in a flowchart.

As shown in FIG. 5, during the image formation, if the development driving time exceeds predetermined sheet counts, an image patch is first formed, the toner density of the image patch is sensed using the ID sensor 28, and the surface potential of the developing roller 2 at this time is sensed by the surface potential sensing sensor 29. The charge amount calculated from these sensing results is decided as the charge amount of the toner 5 on the developing roller 2. If the obtained charge amount is below a threshold, the bias voltage Vdc3 of the collecting roller 14 is increased in a direction in which the scattered toner is attracted.

In the above-described control, the above-described operation may be executed during image patch formation by calibration of the image adjustment.

More specifically, an image patch is formed during non-image formation time, and the toner density on the intermediate transfer body 20 is sensed using the ID sensor 28. At the same time, the surface potential of the toner thin layer 9 formed on the developing roller 2 is measured using the surface potential sensor 29. Based on the sensing results, the toner charge amount of the toner thin layer 9 is calculated from a predetermined data table indicating relationships between the toner density and the surface potential, and the toner charge amount. The calculated toner charge amount is compared with a threshold of the toner charge amount of the toner thin layer 9 prepared in advance, and based on the result, the bias voltage applied to the collecting roller 14 is controlled. For example, if the threshold is 6 μC/g and the calculated toner charge amount is 5.5 μC/g, the bias voltage Vdc3 of the collecting roller 14 is set to be lower than that of the magnetic roller 1 by 40 to 60 V to facilitate the attraction of the scattered and suspended toner and the captured toner on the collecting roller 14 to the collecting roller 14 side. On the contrary, if the calculated toner charge amount is higher than the threshold, the bias voltage applied to the collecting roller 14 is set to the same potential as that of the magnetic roller 1.

At the same time, referring to a data table indicating the relationships between the toner charge amount of the toner thin layer 9 and the potential difference ΔV, which is prepared in advance, ΔV is adjusted to perform the control to keep the toner thin layer thickness constant.

Second Embodiment

Figure 7:
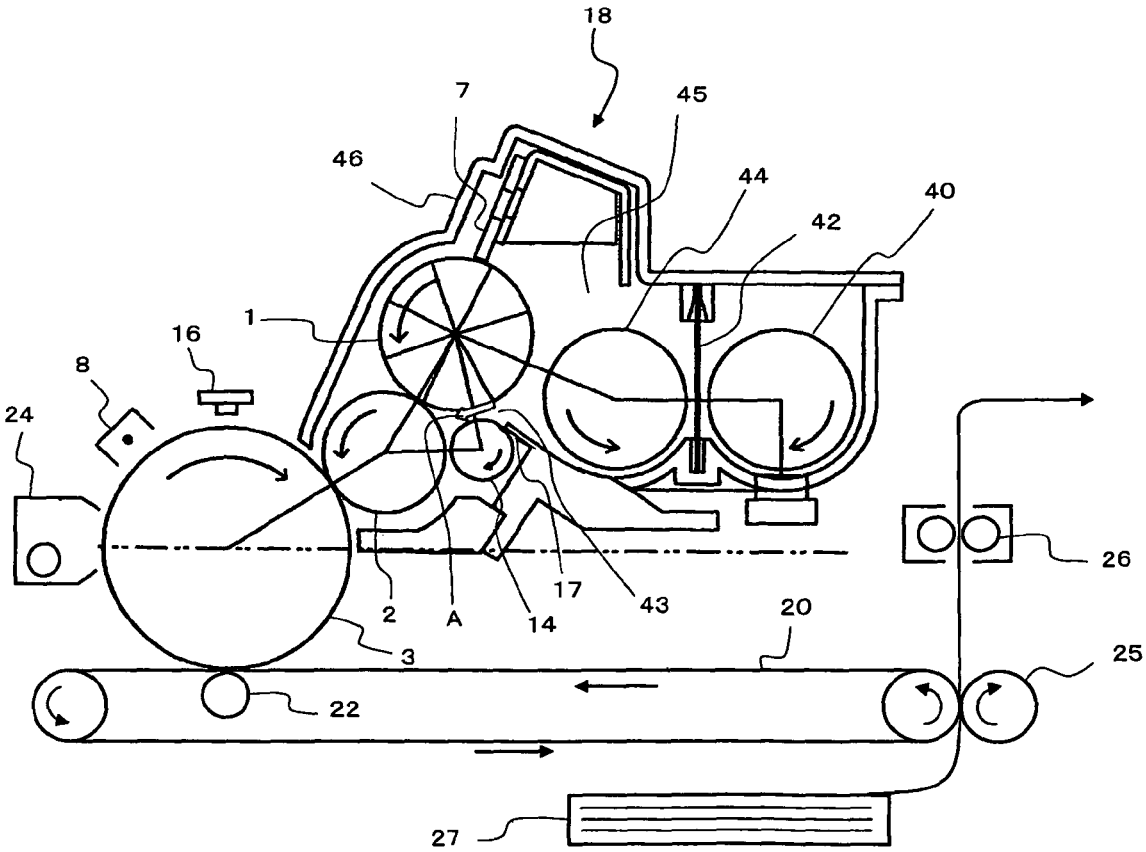
FIG. 7 is an explanatory diagram showing a schematic configuration of a touchdown-development type image forming apparatus according to a second embodiment of the present invention.
Figure 8:
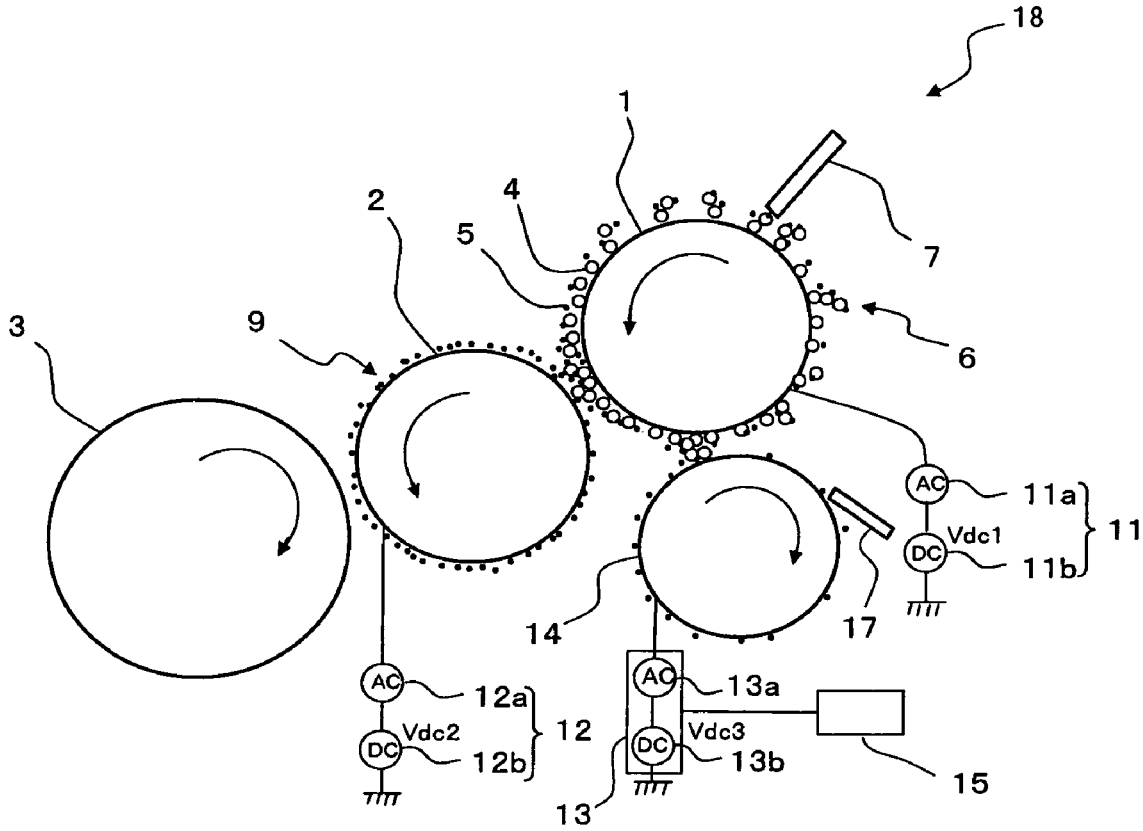
FIG. 8 is a schematic configuration diagram showing part of developing means of FIG. 7.

Hereinafter, a second embodiment of the present invention will be described in detail based on the drawings. FIG. 7 is an explanatory diagram showing a schematic configuration of a touchdown developing type image forming apparatus according to this embodiment. FIG. 8 is a schematic configuration diagram showing part of developing means in FIG. 7. For the same members as those in the first embodiment, the same reference numerals are given, and their description may be omitted.

(Image Forming Apparatus)

The image forming apparatus of this embodiment forms an image by a so-called touchdown developing method as described before. As shown in FIG. 7, the image forming apparatus is provided with the photoreceptor 3 (electrostatic latent image holding body), and around this photoreceptor 3, the charging means 8, the exposing means 16, the developing means 18, the primary transfer means 22, the secondary transfer means 25, the fixing means 26, the cleaning means 24 and the like are arranged.

The image formation by the image forming apparatus is performed as in the first embodiment.

The developing means 18 is made of the sleeve-like magnetic roller 1 (two-component developer holding body) inside of which a plurality of magnetic members are provided so as to be fixed, and that rotates around outer circumferential portions of the magnetic members, the sleeve-like developing roller 2 (toner holding body) inside of which a magnetic member of different polarity from that of the magnetic roller 1 is provided so as to be fixed, and that rotates around an outer circumferential portion of the magnetic member, the regulatory blade 7 for keeping constant a height of the magnetic brush 6 formed on the magnetic roller 1 by a magnetic field, which is formed by magnetic attractions of the different magnetic polarities of the magnetic roller 1 and the developing roller 2, and the toner collecting roller 14 (hereinafter, also referred to as a collecting roller) for collecting the scattered toner. Furthermore, the developing means 18 is equipped with the alternating current (AC) bias electric source 11*a* and the direct current (DC:Vdc1) bias electric source 11*b* to be applied to the magnetic roller 1, the alternating current (AC) bias electric source 12*a* and the direct current (DC: Vdc2) bias electric source 12*b* to be applied to the developing roller 2, and the alternating current (AC) bias electric source 13*a* and the direct current (DC: Vdc3) bias electric source 13*b* to be applied to the toner collecting roller 14. Moreover, control means 15 for controlling the bias voltage to be applied to the toner collecting roller 14 is provided.

This image forming apparatus, as shown in FIG. 3, can be preferably used for a tandem-type (indirect transfer tandem-type) color image forming apparatus, in which the four photoreceptors 3A, 3B, 3C, 3D are arrayed on the intermediate transfer body 20.

As described in the first embodiment, in the touchdown method, the toner scatter easily occurs, and particularly as the process linear velocity becomes higher, the collected toner amount becomes larger, so that the toner scatter is more likely to increase.

The scattered toner is likely to occur when the printing ratio is low. As described above, when it is less than 5%, much undeveloped toner remains on the developing roller 2, which is collected by the two-component developer composed of at least the carrier 4 and the toner 5 held on the magnetic roller 1, and is collected into the two-component developer containing part 45 inside of the developing apparatus 18 together with the two-component developer on the magnetic roller 1. Accordingly, since the amount of the collected toner is large, the toner amount in the collected two-component developer is also large, which easily causes the toner scatter when the two-component developer on the magnetic roller 1 is collected into the two-component developer containing part 45.

The scattered toner causes various poor images, improper operations and the like, and particularly, the scattered toner adheres to the surface of the developing roller 2, thereby easily causing a ghost phenomenon arising from poor peeling, which is one of factors preventing favorable image formation.

(Toner Collecting Roller)

The toner collecting roller 14 is intended to capture the scattered toner and return the same to the magnetic roller 1, and as shown in FIG. 7, in the arrangement configuration of the photoreceptor 3, the developing roller 2, the magnetic roller 1, and the stirring screws 40, 44, it is disposed on the downstream side in the rotational direction of the magnetic roller 1 from the closest position of the magnetic roller 1 and the developing roller 2, being opposed to the magnetic roller 1 so as to shut the clearance between the magnetic roller 1 and the housing 46 wall.

With the above-described configuration, the scattered toner suspended in the vicinity of the developing roller 2 and the magnetic roller 1, and the scattered toner that moves in an arrow direction A in FIG. 7 through the clearance on the lower side of the magnetic roller 1 and scatters inside of the image forming apparatus can be caused to adhere to the toner collecting roller 14 surface by intermolecular force, electrostatic force and the like to be captured.

The collecting roller 14 may preferably rotate in a circumferential direction. A rotational direction of the collecting roller 14 may be the same direction as the rotational direction of the magnetic roller 1 (trail rotation with respect to the magnetic roller 1) in the opposed position, or may be a reverse direction (counter rotation). The trail rotation is preferable. The circumferential velocity of the collecting roller 14 and the material of the rotating sleeve of the collecting roller 14 may be the same as those in the above-described embodiment.

To the toner collecting roller 14 is applied a bias voltage by the bias means 13 for collecting the scattered toner, and the bias voltage is controlled using the control means 15. That is, the control of the bias voltage is such that the bias voltage is applied to the toner collecting roller 14 in accordance with the printing ratio.

In the image forming apparatus according to the present invention, based on image information, by laser light emitted from a scanner unit, a toner image is formed on the surface of the photoreceptor 3 as an aggregate of light dots condensed into a diameter of several tens μm. Accordingly, by integrating a number of laser dots composing the toner image, the printing ratio can be calculated.

As described above, when the printing ratio is less than 5%, for example, much undeveloped toner remains on the developing roller 2, which is collected by the two-component developer composed of at least the carrier 4 and the toner 5 held on the magnetic roller 1, and is collected into the two-component developer containing part 45 inside of the developing apparatus together with the two-component developer on the magnetic roller 1. Accordingly, since the amount of the collected toner is large, the toner amount in the collected two-component developer is also large, which easily causes the toner scatter when the two-component developer on the magnetic roller 1 is collected into the two-component developer containing part.

Accordingly, since by applying a bias of reverse polarity to the that of toner 5 to an electrode of the collecting roller 14, the scattered and suspended toner is attracted and easily collected, and the toner 5 is also attracted by the magnetic roller 1, the toner amount in the two-component developer is reduced before the two-component developer on the magnetic roller 1 is collected into the two-component developer containing part 45, thereby suppressing the toner scatter.

If the printing ratio is 5 to 15%, for example, the undeveloped toner amount is appropriate, thereby resulting in a state where the toner scatter hardly occurs. Since in a state where no DC bias is applied, the potential of the magnetic roller 1 is higher, the scattered toner is attracted to the electrode of the collecting roller 14 where the potential is relatively low, and as in the foregoing, since the toner 5 is also attracted by the magnetic roller 1, the toner scatter can be suppressed. Moreover, applying no DC bias leads to reduction in power consumption.

Moreover, if the printing ratio exceeds 15%, for example, there is less undeveloped toner on the developing roller 2, and thus the toner amount collected by the magnetic roller 1 will be also smaller. Accordingly, the toner scatter when the two-component developer on the magnetic roller 1 is collected into the two-component developer containing part 45 will be extremely less. Accordingly, by superimposing an AC bias on a DC bias of the same polarity as that of the toner 5 in the electrode of the collecting roller 14, the toner 5 is not attracted to the electrode of the collecting roller 14 from the magnetic roller 1. Preferably, the DC bias applied to the collecting roller 14 is the same potential as that of the magnetic roller 1 or more.

Figure 9:
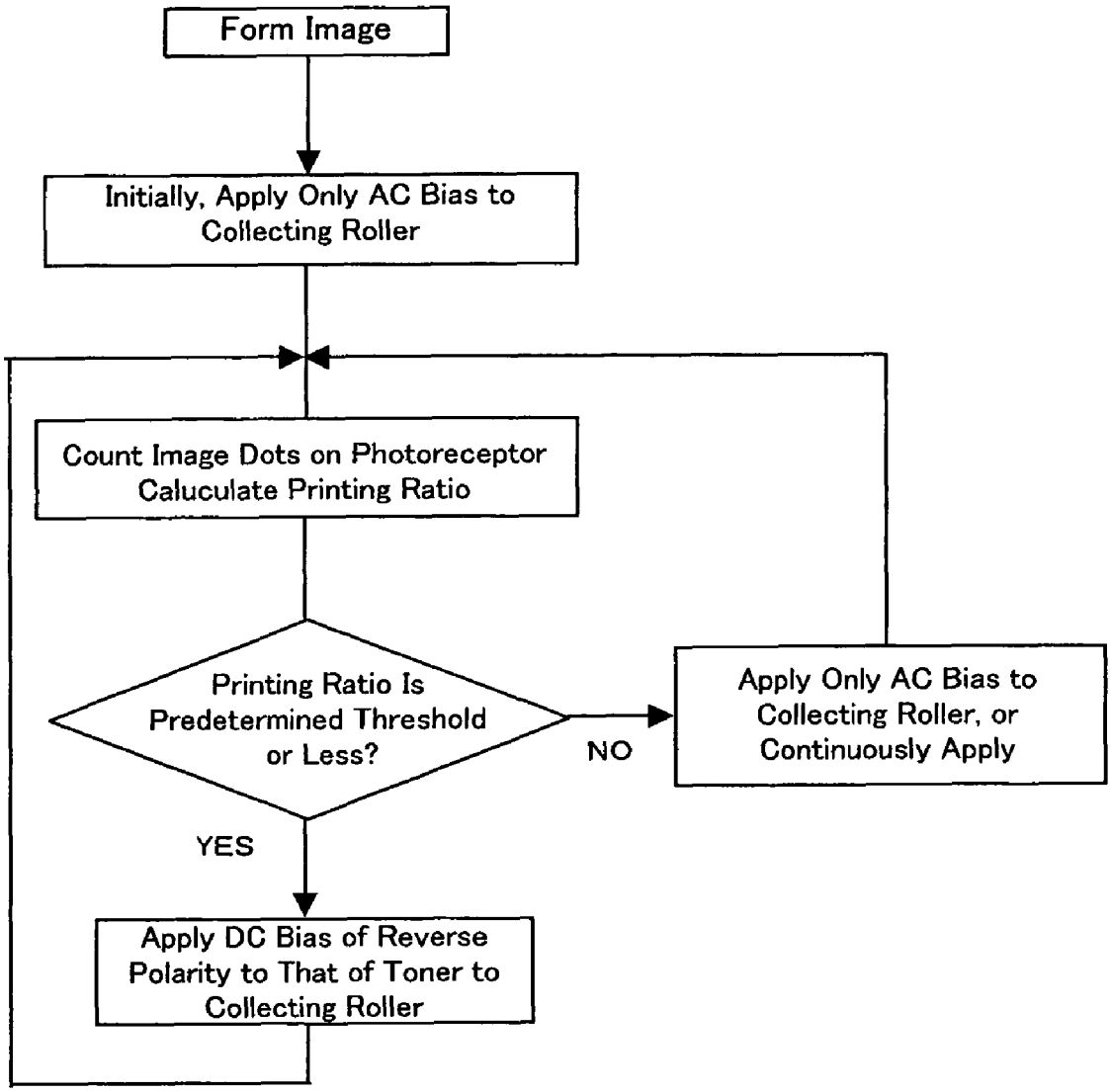
FIG. 9 is a flowchart showing one example of the control of a bias voltage applied to the toner collecting roller in the second embodiment of the present invention.

FIG. 9 shows one example of the control of the bias voltage applied to the collecting roller 14 in a flowchart. An AC bias voltage is initially applied to the collecting roller 14. The printing ratio is calculated through analyzing means (not shown) based on the number of dots of a toner image formed on the photoreceptor 3 during image formation.

Next, the calculated printing ratio is compared with a predetermined threshold, for example, 5 to 10%. If the printing ratio is the predetermined threshold or more, the bias being applied to the collecting roller 14 is not changed, and only the AC bias voltage is applied continuously. If the printing ratio is the predetermined threshold or less, a DC voltage of reverse polarity to the polarity of the toner having a normal charge characteristic is applied to the collecting roller 14.

Figure 10:
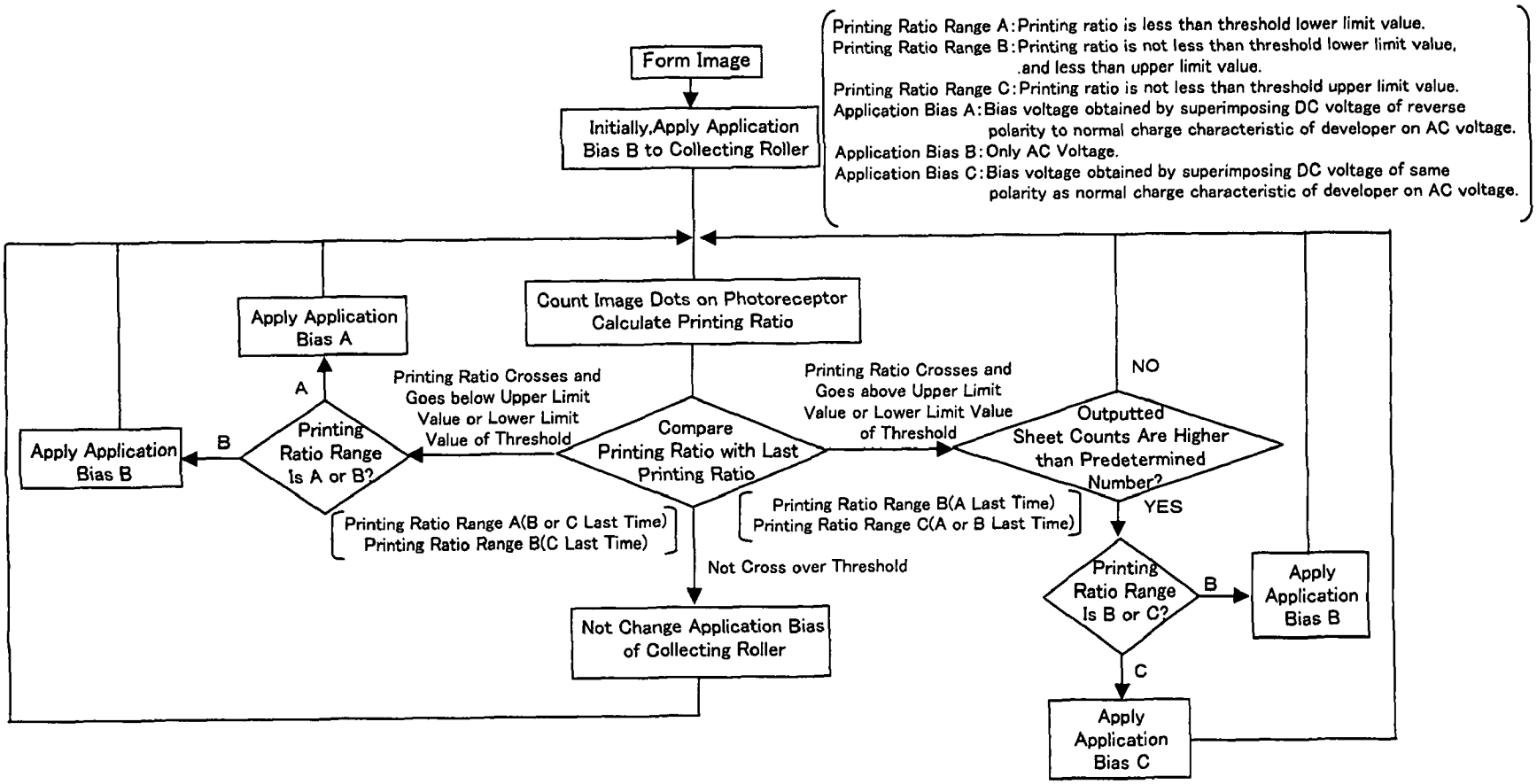
FIG. 10 is a flowchart showing another example of the control of the bias voltage applied to the toner collecting roller in the second embodiment of the present invention.

FIG. 10 shows another example of controlling the bias voltage applied to the collecting roller 14. Only an AC bias voltage (bias B) is initially applied to the collecting roller 14. The printing ratio is calculated through analyzing means (not shown) based on the number of dots of a toner image formed on the photoreceptor 3 during image formation.

Next, On assumption that the printing ratio is set to a predetermined threshold range, for example, a lower limit value of the threshold range is 1 to 10%, preferably about 5%, and that an upper limit value is set to 7 to 20%, preferably about 15%, and that a range of the printing ratio of less than the threshold lower limit value is a printing ratio range A, that a range of the printing ratio of not less than the threshold lower limit value and less than the upper limit value is a printing ratio range B, and that a range of the printing ratio of not less than the threshold upper limit value is a printing ratio range C, the above-described calculated printing ratio is compared with the last printing ratio range.

If the printing ratio does not cross over the threshold (the same as the last printing ratio range), the application bias, which has been applied to the collecting roller 14, is not changed, but the last application bias is continuously applied as it is. If the printing ratio crosses and goes below the upper limit value or the lower limit value of the threshold, the application bias is applied in accordance with the printing ratio range at this time. That is, if the printing ratio is in the printing ratio range A (the last printing ratio range is B or C), a bias voltage (application bias A) obtained by superimposing a DC voltage of the reverse polarity to the normal charge characteristic of the developer on an AC voltage is applied. If the printing ratio is in the printing ratio range B (the last printing ratio range is C), a bias voltage of only the AC voltage (application bias B) is applied. If the printing ratio crosses and goes above the upper limit value or the lower limit value of the threshold, the number of outputted sheets of the printing is counted at this point of time, and when the counting exceeds a predetermined number of sheets, for example, 2 to 5 sheets, the application bias is applied in accordance with the printing ratio range at this time. That is, if the printing ratio is in the printing ratio range C (the last printing ratio range is A or B), a bias voltage (application voltage C) obtained by superimposing a DC voltage of the same polarity as the normal charge characteristic of the developer on an AC voltage is applied. If the printing ratio is in the printing ratio range B (the last printing ratio range is A), the bias voltage of only the AC voltage (application bias B) is applied.

In the foregoing, a reason for providing a counting limit in number of outputted sheets is as follows. That is, the toner scatter is not reduced instantly even when the printing ratio is switched over, but once the toner scatter begins, the suspended toner exists for a while. Accordingly, for example, when the printing ratio is changed from less than 5%, in which the toner scatter easily occurs, to 5% or more, or when the printing ratio is changed from 5 to 15% to a state exceeding 15%, it is preferable that the setting of the application bias of the toner collecting roller 14 is not switched over instantly, but for a while, for example, until the output of two or three sheets has been completed, the application bias is maintained as it is, and thereafter, the application bias is changed. When the application bias is changed in the direction in which the printing ratio decreases, there is possibility that toner scatter instantly occurs, and thus, the application bias is instantly changed.

Moreover, although since the printing ratio can be calculated for each image, the application bias may be changed for each image, an average printing ratio of about several to ten-odd sheets, for example, 10 sheets may be calculated, and the application bias may be changed in accordance with this.

In the collecting roller 14, a collecting blade 17 may be provided (refer to FIG. 7). This collecting blade 17 can scrape the toner captured on the collecting roller 14 to return the same to the stirring screw 40. In this case, the collecting blade 17 is arranged on the stirring screw 40 side so that it can press and contact the collecting roller 14 surface. With the rotational direction of the collecting roller 14, the collecting roller 14 may preferably rotate in a direction in which the toner is returned to the screw 40 in a position opposed to the magnetic roller 1. The rotation in the direction toward the stirring screw 40 allows the scattered toner on the collecting roller 14, which has been peeled by the collecting blade 17, to be easily collected to the stirring screw 40 side. Moreover, the collecting blade 17 can also be used to regulate the thickness of the toner layer formed of the collected toner. In this case, the collecting blade 17 is arranged at a distance of a desired layer thickness from the collecting roller 14 surface. Since this prevents the layer thickness of the captured toner on the collecting roller 14 from increasing, the scraping by the magnetic brush 6 is performed favorably, and re-scatter of the toner during scraping can be prevented.

However, the collecting blade 17 for scraping may not be installed. In this case, a bias that returns the scattered toner collected and accumulated on the toner collecting roller 14 during non-image formation onto the magnetic roller 1 is applied. In the case of the application of bias, for example, the setting is made such that to the toner collecting roller 14 is applied Vdc3=100 V, Vpp=300 V in the reverse phase to that of the magnetic roller 1, frequency f=2.7 kHz, Duty ratio=30%, and to the magnetic roller is applied Vdc1=−100 V, Vpp=300 V in the reverse phase to that of the developing roller 2, frequency f=2.7 kHz, Duty ratio=70%. At this time, since the toner 5 may not be moved between the developing roller 2 and the magnetic roller 1, no bias may not be applied to the developing roller 2. If any bias is applied, Vdc2=100 V, Vpp=1.6 kV, frequency f=2.7 kHz, Duty ratio=30% may be applied.

Thus, collecting the adhering toner to the magnetic roller 1 side by bias application is preferable as compared to collecting by the collecting blade 17 because influence of stress with the collecting blade 17 is not suffered, which brings about an effect of reducing deterioration of the toner 5 such as embedding and peeling of an external additive of the toner 5.

(Developing Method)

FIG. 8 schematically shows part of the developing means according to the present invention. The development is performed as with the development described based on FIG. 2 in the first embodiment.

After the development, the developing roller 2 having the remaining toner layer becomes closest to the magnetic roller 1 having a developer layer in the opposite position, where the toner layer 9 on the developing roller 2 is scraped by mechanical force by the magnetic brush 6. At the same time, the toner 5 is supplied to the developing roller 2 side from the developer layer on the magnetic roller 1 in accordance with the potential difference (i.e., electric field) formed between the magnetic roller 1 and the developing roller 2. Bias conditions and AC conditions during development are similar to those of the first embodiment.

Third Embodiment

Figure 11:
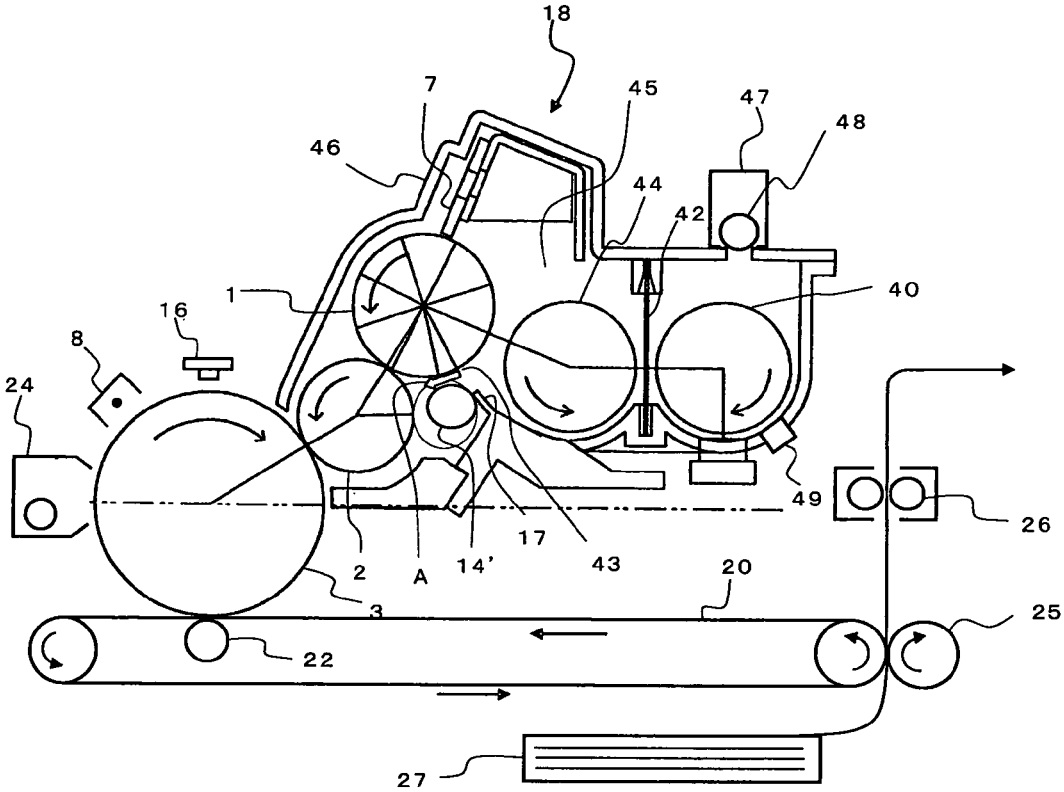
FIG. 11 is an explanatory diagram showing a schematic configuration of a touchdown-development type image forming apparatus according to a third embodiment of the present invention.
Figure 12:
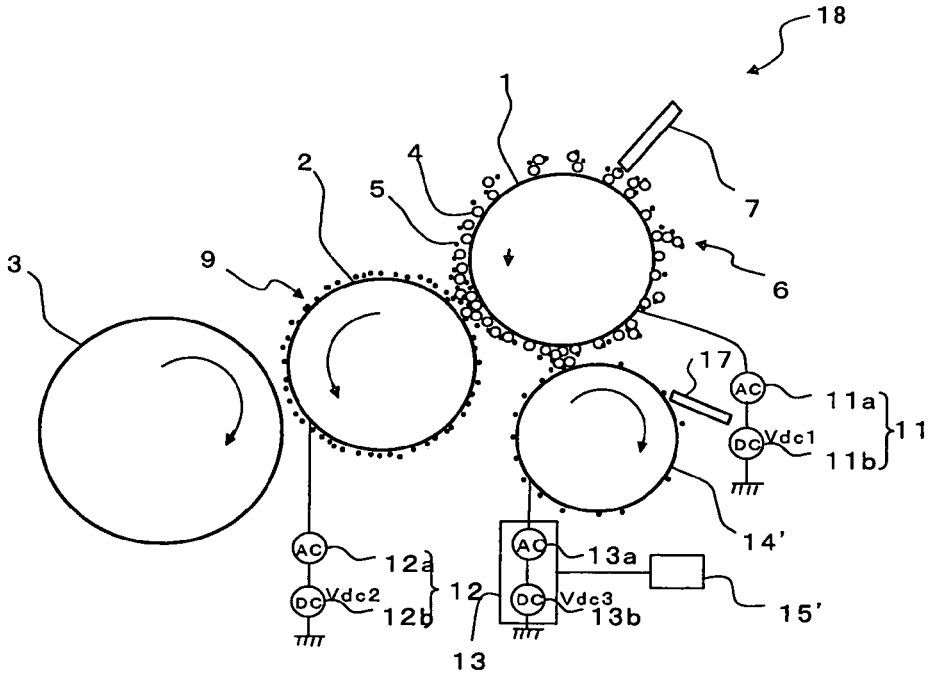
FIG. 12 is a schematic configuration diagram showing part of developing means of FIG. 11.

Hereinafter, an embodiment of the present invention will be described in detail based on the drawings. FIG. 11 is an explanatory diagram showing a schematic configuration of a touchdown developing type image forming apparatus according to one embodiment of the present invention. FIG. 12 is a schematic configuration diagram showing part of developing means in FIG. 1. For the same members as those in the first and second embodiments, the same reference numerals are given, and their description may be omitted.

(Image Forming Apparatus)

The image forming apparatus of this embodiment forms an image by a so-called touchdown developing method as described before. As shown in FIG. 11, the image forming apparatus is provided with the photoreceptor 3 (electrostatic latent image holding body), and around this photoreceptor 3, the charging means 8, the exposing means 16, the developing means 18, the primary transfer means 22, the secondary transfer means 25, the fixing means 26, the cleaning means 24, toner replenishing means 47 and the like are arranged.

The image formation by the image forming apparatus is performed as in the first embodiment. The developing means 18 is made of the sleeve-like magnetic roller 1 (two-component developer holding body) inside of which a plurality of magnetic members are provided so as to be fixed, and that rotates around outer circumferential portions of the magnetic members, the sleeve-like developing roller 2 (toner holding body) inside of which a magnetic member of different polarity from that of the magnetic roller 1 is provided so as to be fixed, and that rotates around an outer circumferential portion of the magnetic member, the regulatory blade 7 for keeping constant a height of the magnetic brush 6 formed on the magnetic roller 1 by a magnetic field, which is formed by magnetic attraction of the different magnetic polarities of the magnetic roller 1 and the developing roller 2, and an electrode member 14' for collecting the scattered toner. Furthermore, the developing means 18 is equipped with the alternating current (AC) bias electric source 11*a* and the direct current (DC:Vdc1) bias electric source 11*b* to be applied to the magnetic roller 1, the alternating current (AC) bias electric source 12*a* and the direct current (DC: Vdc2) bias electric source 12*b* to be applied to the developing roller 2, and the alternating current (AC) bias electric source 13*a* and the direct current (DC: Vdc3) bias electric source 13*b* to be applied to the electrode member 14'. Moreover, control means 15' for controlling the bias voltage to be applied to the electrode member 14' is provided.

Moreover, the image forming apparatus of the present invention is equipped with the toner container 47 in which the toner 5 is stored as the toner replenishing means, and the housing 46 in which the magnetic roller 1, the developing roller 2, the stirring screw 40 and the stirring screw 44 are contained. The stirring screw 40 and the stirring screw 44 stir the toner 5 supplied from the toner container 47 to the two-component developer containing part 45, which contains the two-component developer, together with the carrier 4 to charge the same. Both the stirring screws 40, 44 communicate with each other at both end portions of the dividing plate 42, and supply, to the magnetic roller 1, part of the two-component developer supplied from the stirring screw 40 to the stirring screw 44 through the one end side, and the stirring screw 44 circulates the remaining two-component developer to the stirring screw 40 side through the other end side of the dividing plate 42.

This image forming apparatus, as shown in FIG. 3, can be preferably used for a tandem-type (indirect transfer tandem-type) color image forming apparatus, in which the four photoreceptors 3A, 3B, 3C, 3D are arrayed on the intermediate transfer body 20.

As described in the above embodiment, in the touchdown method, the toner scatter easily occurs, and particularly as the process linear velocity becomes higher, the collected toner amount becomes larger, so that the toner scatter is more likely to increase.

Moreover, the scattered toner is likely to occur when the toner replenishment amount becomes larger. As described above, when the toner replenishment amount is large, i.e. when a driving time of a toner replenishing roller 48 is longer, when the number of rotations of the toner replenishing roller 48 becomes large, or the like, the toner 5 may be fed to the vicinity of the magnetic roller 1 when frictional charge of the replenished toner 5 is insufficient, and since the toner 5 insufficient in charge has weak adherence to the carrier 4, it separates from the carrier 4 by centrifugal force by the rotation of the magnetic roller 1, pressure when the magnetic brush 6 is collected into the two-component developer containing part 45, and the like, thereby easily causing the toner scatter.

(Electrode Member)

The electrode member 14' is intended to capture the scattered toner and return the same to the magnetic roller 1, and as shown in FIG. 11, in the arrangement configuration of the photoreceptor 3, the developing roller 2, the magnetic roller 1, and the stirring screws 40, 44, it is disposed on the downstream side in a rotational direction of the magnetic roller 1 from the closest position of the magnetic roller 1 and the developing roller 2, being opposed to the magnetic roller 1 so as to shut the clearance between the magnetic roller 1 and the housing 46 wall.

With the above-described configuration, the scattered toner suspended in the vicinity of the developing roller 2 and the magnetic roller 1, and the scattered toner that moves in an arrow direction A in FIG. 11 through the clearance on the lower side of the magnetic roller 1 and scatters inside of the image forming apparatus can be caused to adhere to an electrode member 14' surface by intermolecular force, electrostatic force and the like to be captured.

Figure 13:
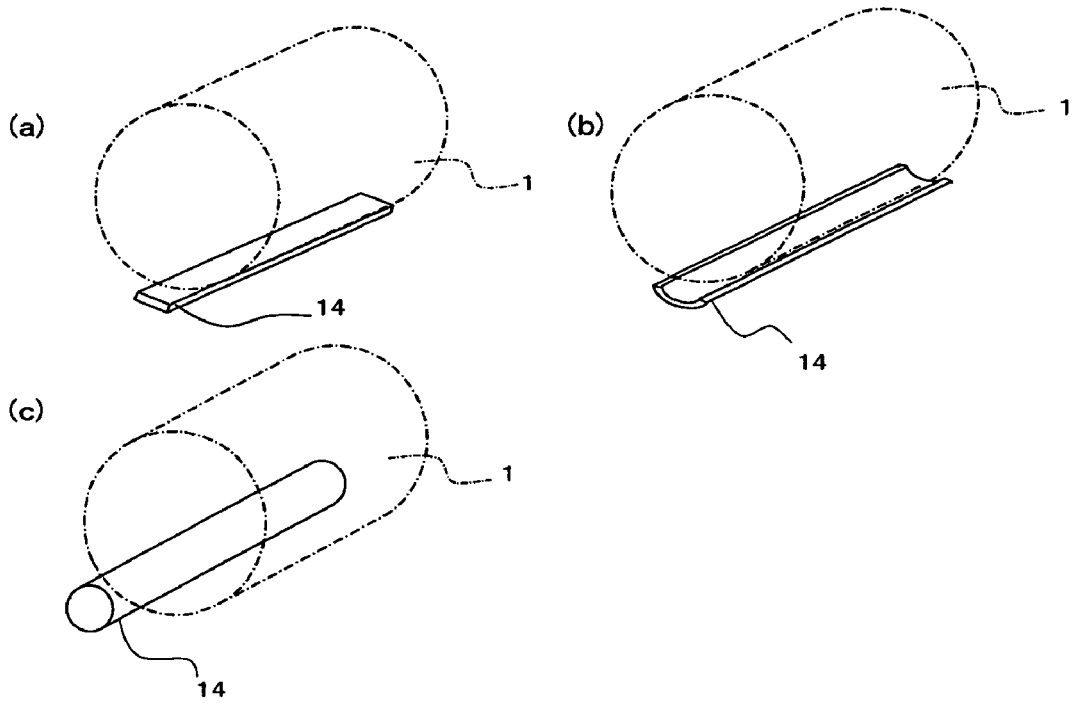
FIG. 13 is a diagram showing examples of a shape of an electrode member in the third embodiment.

For the electrode member 14', while as shown in FIG. 13, a flat plate shape, a shape in which a surface opposed to the magnetic roller 1 forms a substantially same curved surface as the magnetic roller 1 surface, a roller shape and the like are cited, any one that is disposed in opposition to the magnetic roller 1 so as to shut the clearance between the magnetic roller 1 and the housing 46 wall may be employed, and thus the shape is not limited to the above-described ones. The roller shape is preferable because collectability of the scattered toner is favorable, and the collected scattered toner is easily returned to the two-component developer containing part 45 through the magnetic brush 6 formed on the magnetic roller 1.

In the case where the electrode member 14' is of the roller shape, the roller may preferably rotate in a circumferential direction. This allows the scattered toner adhering to the surface of the roller to come into contact with the magnetic brush 6 formed on the magnetic roller 1 to be peeled and returned to the magnetic roller 1 side. The rotational direction of the roller 14' may be the same direction as the rotational direction of the magnetic roller 1 (trail rotation with respect to the magnetic roller 1) in the opposite position, or may be a reverse rotation to that of the magnetic roller 1 (counter rotation). The trail rotation is preferable.

A circumferential velocity of the roller is preferably 5 to 100 mm/sec, more preferably 10 to 70 mm/sec. If the circumferential velocity of the roller is less than 5 mm/sec, the collecting amount of the scattered toner is not favorable because the number of rotations is too small. Moreover, if it exceeds 100 mm/sec, the collectability of the scattered toner is decreased and when the adhering toner is peeled by the magnetic brush 6, there is possibility that the toner again scatters, which is not favorable.

For a material of the electrode member 14', metal such as aluminum and stainless steel (SUS) can be used. It is preferable that aluminum subjected to alumite treatment having a large specific surface area is used in view of adhesive property of the scattered toner, or/and that its surface is covered with fluorine resin or the like in view of electrostatic adhesive property (in the case where the charge characteristic of the toner is positive).

Moreover, in the case where the electrode member 14' is of the roller shape, the scattered toner adhering to the surface of the roller may be collected by the magnetic brush 6, and further the remaining toner may be removed and collected by the collecting blade 17 arranged in contact with the surface of the roller. For a material of the collecting blade 17, publicly-known ones such as polyurethane rubber can be used.

To the electrode member 14' is applied a bias voltage by bias means 13 for collecting the scattered toner, and the bias voltage is controlled using the control means 15'. That is, the control of the bias voltage is such that the bias voltage is applied to the electrode member 14' in accordance with the toner replenishment amount.

That is, if the charge characteristic of the toner 5 is positive, and when the toner replenishment amount is large, a potential of the electrode member 14' is made lower than a potential of the magnetic roller 1 to thereby capture the scattered toner. If the charge characteristic of the toner 5 is negative, conversely, the potential of the electrode member 14' may be made higher. That is, a bias that allows the toner 5 charged into the normal charge characteristic to be easily attracted may be applied. Accordingly, applying a bias of the reverse polarity to that of the toner 5 is the most preferable. When the bias of the reverse polarity to that of the toner 5 is applied, the toner 5 is also attracted directly from the two-component developer on the magnetic roller 1, which can further prevent the toner scatter. Moreover, since the toner scatter by the toner replenishment is temporary, sufficient stirring and mixing results in a sufficient value of friction charge of the toner 5, thereby preventing the toner scatter. Accordingly, the scattered toner may be preferably replenished and collected at least temporarily, and the toner collected at timing other than the toner replenishment may be returned to the magnetic roller 1.

In the control of the toner replenishment, the replenishment amount of the toner 5 to the two-component developer containing part 45 is controlled by controlling the drive of the toner replenishing roller 48 of the toner container 47 in accordance with an output value (hereinafter, referred to as a toner container output value), which is outputted based on a detection signal from a toner amount detecting sensor 49 disposed below the stirring screw 40. As the toner amount detecting sensor 49, a magnetic sensor, a piezoelectric sensor or the like can be used, and the magnetic sensor is preferable. The toner amount detecting sensor 49 may be provided beside the stirring screw 40.

Figure 14:
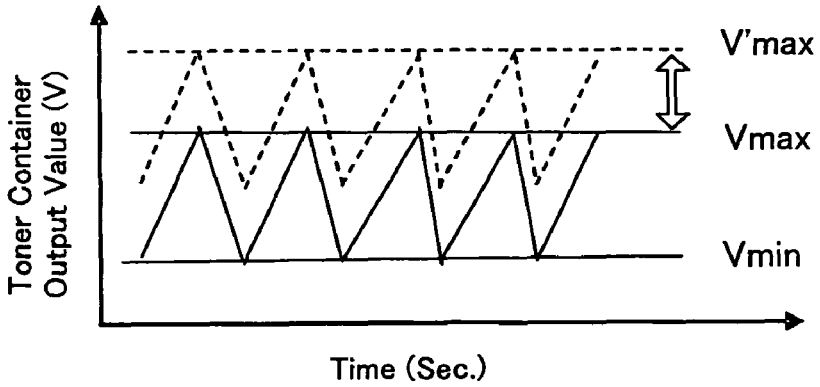
FIG. 14 is a diagram showing one example of time change in a toner container output value in the third embodiment.

FIG. 14 shows one example of time change of the toner container output value. In a toner container output waveform shown in FIG. 14, its voltage varies between high (Vmax) and low (Vmin) (solid line in FIG. 14) in accordance with a rotation period of the stirring screw 40. When the toner is consumed by printing, and the toner density in the developer decreases, the waveform rises as shown in a dashed line, Vmax becomes V'max. Conversely, when the toner is replenished and the toner density rises, the waveform decreases, and V'max becomes Vmax. Here, the control is performed such that when the Vmax value exceeds a threshold (TARGET value), the toner replenishing roller is driven to execute the toner replenishment, and when the Vmax value becomes the threshold or lower, the toner replenishing roller is stopped to keep the toner density constant.

The toner replenishing method from the toner container 47 is intermittent replenishment in which, for example, ON/OFF of the toner replenishing roller 48 in accordance with the toner container output value is varied, and the time setting of ON/OFF is performed in the following five steps in accordance with a voltage difference between the toner container output value and the threshold value (TARGET value).

(1) If the toner container output value is less than TARGET value+0.2 V: ON (0.2 sec.)/OFF (0.6 sec.)

(2) If the toner container output value is less than TARGET value+0.2 V to +0.4 V: ON (0.4 sec.)/OFF (0.6 sec.)

(3) If the toner container output value is less than TARGET value+0.4 V to +0.6 V: ON (0.6 sec.)/OFF (0.6 sec.)

(4) If the toner container output value is less than TARGET value+0.6 V to +0.8 V: ON (0.6 sec.)/OFF (0.4 sec.)

(5) If the toner container output value is TARGET value+0.8 V or more: ON (0.6 sec.)/OFF (0.2 sec.)

In the case of the above-described intermittent toner replenishment control, when an ON/OFF ratio becomes higher, shortage of the charge amount due to the stirring of the replenished toner occurs, and thus the toner scatter tends to increase. Consequently, in the case of the above-described (4), (5), an application voltage of the electrode member 14 may be preferably changed to a lower voltage from the same potential as that of the magnetic roller 1.

When the toner replenishing roller 48 is driven for 0.2 sec., setting is made so that the toner 5 of about 0.2 g is replenished. Moreover, the TARGET value is set so that the toner density reaches an appropriate density, which varies depending on a particle diameter of the used carrier 4, for example, 5 to 15%.

Figure 15:
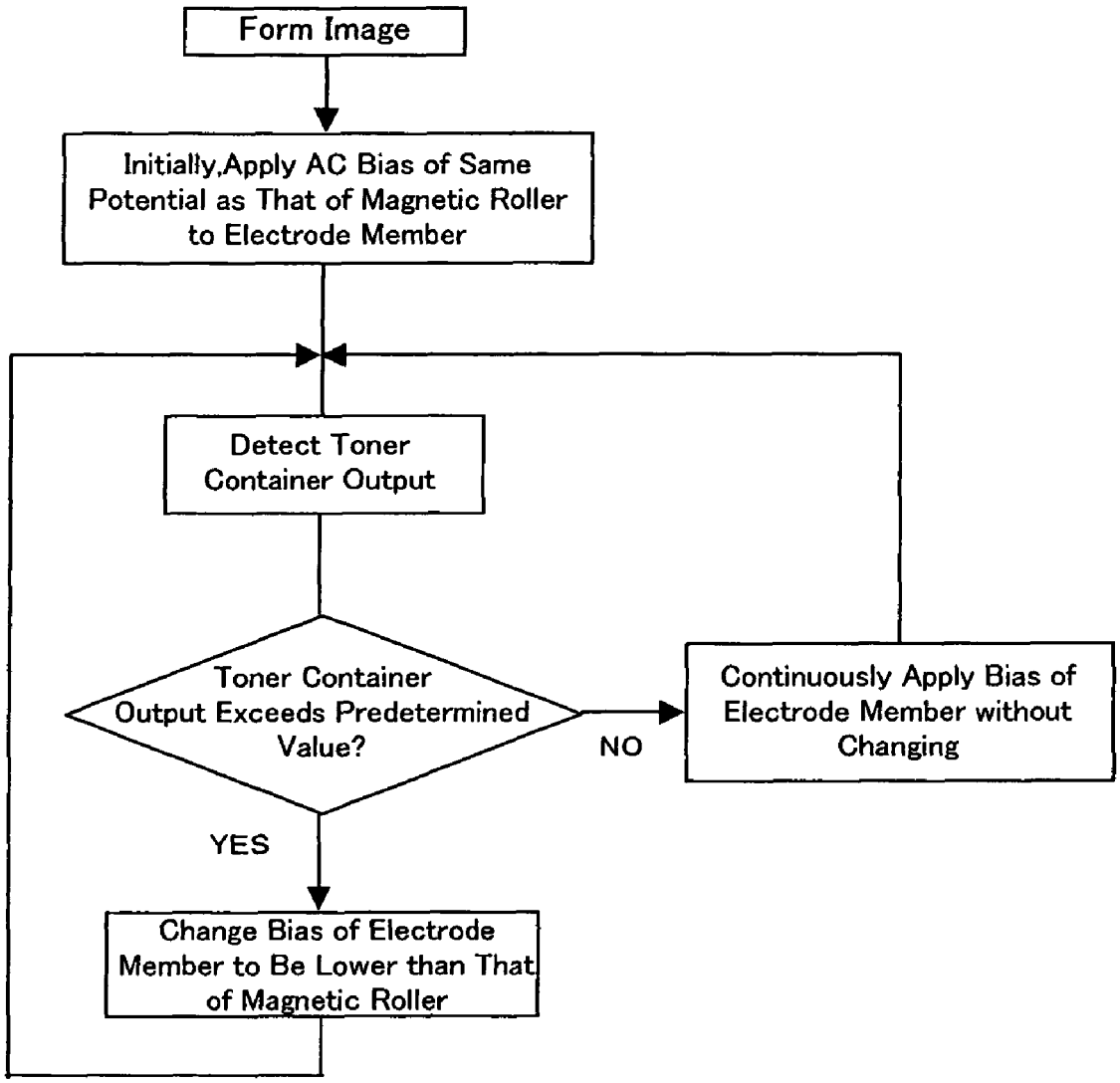
FIG. 15 is a flowchart showing one example of the control of a bias voltage applied to the electrode member in the third embodiment.

FIG. 15 shows one example of the control of the bias voltage applied to the electrode member 14 in a flowchart. To the electrode member 14' is initially applied an AC bias voltage of the same potential as that of the magnetic roller 1. During image formation, the toner container output value is obtained by the toner amount detecting sensor 49.

Next, for the obtained toner container output value, the voltage difference from the threshold (TARGET value) is compared, as described before. For example, if the toner output value is less than the TARGET value+0.6V, the bias voltage applied to the electrode member 14' is continued without being changed. If the toner container output value exceeds the TARGET value+0.6 V, and when the normal charge characteristic of the toner 5 is positive charge polarity, the DC voltage of the electrode member 14' is changed so that its potential is lower than the potential of the magnetic roller 1. If the normal charge characteristic of the toner 5 is negative charge polarity, conversely, the DC voltage is changed so that its potential is higher than the potential of the magnetic roller 1.

While it is preferable that the toner container output value when the bias value applied to the electrode member 14' is to be changed is TARGET value+0.6 v or more, an appropriate value may be preferably set as needed because the amount of emergence of the scattered toner varies depending on the toner charge amount, toner particle size distribution, toner particle diameter, magnetic roller circumferential velocity and the like.

Moreover, increase and decrease in the toner replenishment amount may be determined from change in driving time of the toner replenishing roller 48. That is, as a predetermined value of the toner replenishment amount, a predetermined driving time of the toner replenishing roller 48 can also be used.

The scattered toner adhering to, and accumulated on the electrode member 14' can be returned to the magnetic roller 1 by applying a bias for returning the scattered toner to the magnetic roller 1 during non-image formation. In this case, the setting is made such that, for example, Vdc3=500 V, Vpp=300 V in the reverse phase to that of the magnetic roller 1, frequency f=2.7 kHz, Duty ratio=30% is applied to the electrode-member 14'.

In this manner, the scattered toner adhering to the electrode member 14' is collected to the magnetic roller 1 side by the bias application, which prevents the influence of stress, and thus there is an effect of reducing deterioration of the toner 5 such as embedding and peeling of an external additive of the toner 5.

(Developing Method)

FIG. 12 schematically shows part of the developing means according to the present invention. The development is performed as with the development described based on FIG. 2 in the first embodiment.

After the development, the developing roller 2 having the remaining toner layer becomes closest to the magnetic roller 1 having a developer layer in the opposite position, where the toner layer 9 on the developing roller 2 is scraped by mechanical force by the magnetic brush 6. At the same time, the toner 5 is supplied to the developing roller 2 side from the developer layer on the magnetic roller 1 in accordance with the potential difference (i.e., electric field) formed between the magnetic roller 1 and the developing roller 2. Bias conditions and AC conditions during development are similar to those of the first embodiment.

Moreover, a gap between the magnetic roller 1 and the electrode member 14' is substantially a distance allowing the magnetic brush 6 to come into contact with the electrode member 14', and may be preferably smaller than the gap between the magnetic roller 1 and the developing roller 2, 150 to 500 μm, more preferably 200 to 300 μm. Making the distance between the magnetic roller 1 and the electrode member 14' smaller than the distance between the magnetic roller 1 and the developing roller 2 can prevent the scattered toner generated around the magnetic roller 1 from scattering to the developing roller 2 side. Making the gap between the magnetic roller 1 and the electrode member 14' narrower causes leak, and thus in order to suppress this leak, the insulating property needs to be increased by alumite treatment onto the surface of the electrode member 14' to give resistance to the surface. In this case, electric resistivity of the electrode member 14' surface may be preferably $10^7$ to $10^{12}$ Ω·m.

While hereinafter, taking examples, the present invention will be described in detail, the present invention is not limited to only the following examples.

EXAMPLES

Example 1

The image forming apparatus of the present invention shown in FIG. 1 was manufactured in accordance with the specification as described below. Dimensions of respective sleeves of the photoreceptor 3, the developing roller 2, the magnetic roller 1 and the collecting roller 14 were as follows:

Photoreceptor 3: External diameter 30 mm

Developing roller 2: External diameter 20 mm

Magnetic roller 1: External diameter 25 mm

Collecting roller 14: External diameter 10 mm

For the photoreceptor 3, an amorphous silicon drum was used, and for the sleeves of the respective rollers, aluminum was used.

Moreover, circumferential velocities of the drum and the respective rollers were as follows. With a rotational direction of the collecting roller 14, trail rotation with respect to the magnetic roller 1 was employed, that is, the collecting roller 14 and the magnetic roller 1 were rotated in the same direction (direction in which the toner are returned to the screw 40) in the closest position.

Photoreceptor 3: 300 mm/sec

Developing roller 2: 450 mm/sec

Magnetic roller 1: 675 mm/sec

Collecting roller 14: 30 mm/sec

Moreover, as the image density sensing means 28, while there are density sensors produced by OMRON HEALTHCARE Co. Ltd, NICHICON Co. STANLEY ELECTRIC Co., Ltd and the like, in the present example, a density sensor produced by STANLEY was used.

Conditions at the time of image formation using the image forming apparatus manufactured as described above are shown below.

Photoreceptor surface potential: +310 V

Q/m of toner in developer: 20 μC/g

Toner particle diameter (volume average particle diameter): 6.7 μm

Carrier particle diameter (weight average particle diameter): 45 μm

Distance between magnetic roller and developing roller: 350 μm

Distance between magnetic roller and collecting roller: 500 μm

Developing roller applied voltage: Vdc2=100 V, $V_{P-P}$=1.6 kV, frequency f=2.7 kHz, Duty ratio=30%

Magnetic roller applied voltage: Vdc1=300 V, $V_{P-P}$=300 V of the same period, and in the reverse phase with respect to the developing roller, frequency f=2.7 kHz, Duty ratio=70%

Collecting roller applied voltage: a threshold of ΔV was 200 V, and Vdc3=440 V at the time of application (only DC voltage was applied)

Development driving time count: 10 min.

Example 2

Example 2 was similar to Example 1 except that the applied voltage of the collecting roller 14 was controlled by the toner charge amount (developing roller 2 surface potential), and parameters shown below were used to manufacture an image forming apparatus. As the surface potential sensing means 29, a surface potential sensing sensor produced by TDK Co. was used.

Q/m of the toner in the developer: 22 μC/g

Toner particle diameter (volume average particle diameter): 6.5 μm

Carrier particle diameter (weight average particle diameter): 42 μm

Developing roller application voltage: Vdc2=150 V, $V_{P-P}$=1.6 kV, frequency f=2.7 kHz, Duty ratio=27%

Magnetic roller applied voltage: Vdc1=300 V, $V_{P-P}$=300 V of the same period, and in the reverse phase with respect to the developing roller, frequency f=2.7 kHz, Duty ratio=73%

Collecting roller applied voltage: Control in accordance with surface potential change of the developing roller 2, and Vdc3=350 V at the time of application (only DC voltage was applied)

As described above, when using the image forming apparatus in which the toner collecting roller that collects scattered toner was arranged on the downstream side in the rotational direction of the magnetic roller from the closest position of the magnetic roller and the developing roller, and between the magnetic roller and the housing wall to collect the scattered toner adhering to the toner collecting roller by the magnetic roller, the image formation was performed in accordance with the above-described conditions, it was found that the scattered toner was efficiently collected, that deterioration in toner was suppressed, and that stable and favorable image formation was performed.

Example 3

In accordance with a specification as shown below, an image forming apparatus of the present invention shown in FIG. 7 was manufactured. Dimensions of the respective sleeves of the photoreceptor 3, the developing roller 2, the magnetic roller 1 and the collecting roller 14 were as follows.

Photoreceptor 3: External diameter 30 mm

Developing roller 2: External diameter 20 mm

Magnetic roller 1: External diameter 25 mm

Collecting roller 14: External diameter 10 mm

For the drum of the photoreceptor 3, amorphous silicon was used, and for the sleeves of the respective rollers, aluminum was used.

Moreover, circumferential velocities of the respective drums were as follows. With a rotational direction of the collecting roller 14, trail rotation with respect to the magnetic roller 1 was employed, that is, the collecting roller 14 and the magnetic roller 1 were rotated in the same direction (direction in which the toner is returned to the screw 40) in the closest position.

Photoreceptor 3: 300 mm/sec

Developing roller 2: 450 mm/sec

Magnetic roller 1: 675 mm/sec

Collecting roller 14: 30 mm/sec

Conditions at the time of image formation using the image forming apparatus manufactured as described above are shown below.

Photoreceptor surface potential: +310 V (potential after exposure 20 V)

Q/m of toner in developer: 20 μC/g

Toner particle diameter (volume average particle diameter): 6.8 μm

Carrier particle diameter (weight average particle diameter): 45 μm

Distance between magnetic roller and developing roller: 350 μm

Distance between magnetic roller and collecting roller: 250 μm

Distance between developing roller and collecting roller: 1000 μm

Developing roller applied voltage: Vdc2=100 V, $V_{P-P}$=1.6 kV, frequency f=2.7 kHz, Duty ratio=30%

Magnetic roller applied voltage: Vdc1=300 V, $V_{P-P}$=300 V of the same period, and in the reverse phase with respect to the developing roller, frequency f=2.7 kHz, Duty ratio=70%

Collecting roller applied voltage:

(1) Printing ratio was less than 5%; Vdc3=−100 V, $V_{P-P}$=300 V in the reverse phase with respect to the magnetic roller, frequency f=2.7 kHz, Duty ratio=30%

(2) Printing ratio was 5 to 15%; Vdc3=0 V, $V_{P-P}$=300 V in the reverse phase with respect to the magnetic roller, frequency f=2.7 kHz, Duty ratio=30%

(3) Printing ratio was 15% or more; Vdc3=300 V, $V_{P-P}$=300 V in the reverse phase with respect to the magnetic roller, frequency f=2.7 kHz, Duty ratio=30%

Number of output counts: 10 sheets

As described above, when using the image forming apparatus in which the toner collecting roller that collects scattered toner was arranged on the downstream side in the rotational direction of the magnetic roller from the closest position of the magnetic roller and the developing roller, and between the magnetic roller and the housing wall to collect the scattered toner adhering to the toner collecting roller by the magnetic roller, the image formation was performed in accordance with the above-described conditions, it was found that the scattered toner was efficiently collected, that deterioration in toner was suppressed, and that stable and favorable image formation was performed.

Example 4

In accordance with a specification as shown below, an image forming apparatus of the present invention shown in FIG. 11 was manufactured. As the electrode member 14' of the present invention, a roller electrode was used. Dimensions of the respective sleeves of the photoreceptor 3, the developing roller 2, the magnetic roller 1 and the roller electrode 14 were as follows.

Photoreceptor 3: External diameter 30 mm

Developing roller 2: External diameter 20 mm

Magnetic roller 1: External diameter 25 mm

Roller electrode (electrode member 14'): External diameter 10 mm

For the photoreceptor 3 drum, amorphous silicon was used, and for the sleeves of the respective rollers, aluminum was used. Moreover, circumferential velocities of the respective drums were as follows.

Photoreceptor 3: 300 mm/sec

Developing roller 2: 450 mm/sec

Magnetic roller 1: 675 mm/sec

Roller electrode 14: 30 mm/sec

Conditions at the time of image formation using the image forming apparatus manufactured as described above are shown below.

Photoreceptor surface potential: +310 V (potential after exposure 20 V)

Q/m of toner in developer: 27 μC/g

Toner particle diameter (volume average particle diameter): 7.0 μm

Carrier particle diameter (weight average particle diameter): 45 μm

Distance between magnetic roller and developing roller: 350 μm

Distance between developing roller and roller electrode: 1000 μm

Distance between magnetic roller and roller electrode: 250 μm

Developing roller applied voltage: Vdc2=100 V, $V_{P-P}$=1.6 kV, frequency f=2.7 kHz, Duty ratio=30%

Magnetic roller applied voltage: Vdc1=300 V, $V_{P-P}$=300 V of the same period and in the reverse phase with respect to the magnetic roller, frequency f=2.7 kHz, Duty ratio=70%

Toner container output predetermined value at which the roller electrode applied voltage was to be changed; TARGET value+0.8 V Roller electrode applied voltage:

(1) Initial time and a toner container output value were TARGET value+0.8V or less; Vdc3=300 V, $V_{P-P}$=300 V in the reverse phase with respect to the magnetic roller, frequency f=2.7 kHz, Duty ratio=30%

(2) If the toner container output value exceeded TARGET value+0.8V; Vdc3=200 V, $V_{P-P}$=300 V in the reverse phase with respect to the magnetic roller, frequency f=2.7 kHz, Duty ratio=30%

Examples 5, 6, Comparative Example 1

Examples 2, 3 and Comparative Example 1 were manufactured in similar conditions to those of Example 1, except that Vdc3 when the toner container output value exceeded TARGET value+0.8 V was replaced with values shown in Table 1. In Comparative Example 1, since Vdc3=300 V was set, there was no change from initial time, regardless of toner replenishment amount.

(Evaluation)

Using the image forming apparatus manufactured above, the evaluations for image unevenness and toner scatter were conducted by evaluation methods and evaluation standards shown below.

(Image Unevenness)

After 510 sheets of a manuscript with a printing ratio of 2% were outputted continuously, a halftone image was outputted to visually check image unevenness (density unevenness), and the image unevenness evaluation was conducted in accordance with the evaluation standards shown below.

○: There is no image unevenness.

x: There is image unevenness.

(Toner Scatter)

After 510 sheets of a manuscript with a printing ratio of 2% were outputted continuously, the adhesion extents of scattered toner on the roller electrode 14 after 10 sheets were outputted and after 510 sheets were outputted were visually checked, and the toner scatter evaluation was conducted in accordance with the evaluation standards shown below. The Evaluation results are shown in Table 1.

○○: There is little difference between after 10 sheets and after 510 sheets.

○: There are slightly differences between after 10 sheets and after 510 sheets.

Δ: There is difference between after 10 sheets and after 510 sheets, and scattered toner deposits slightly.

x: There is difference between 10 sheets and after 510 sheets, and scattered toner deposits obviously.

These evaluation results are shown in Table 1.

TABLE 1

| | Electrode member | | Magnetic roller | | | |
|---|---|---|---|---|---|---|
| | Vdc3 (V) | Duty ratio (%) | Vdc1 (V) | Duty ratio (%) | Image unevenness | Toner scatter |
| Example 4 | 200 | 30 | 300 | 70 | ○ | ○ |
| Example 5 | 0 | 30 | 300 | 70 | ○ | ○ |
| Example 6 | −100 | 30 | 300 | 70 | ○ | ○○ |
| Comparative Example 1 | 300 | 30 | 300 | 70 | X | X |

As shown in Table 1, in Examples 4 to 6 within the scope of the present invention, since the bias control in accordance with the toner replenishment amount was performed, no image unevenness occurs, and there was less scattered toner, which indicates that the toner scatter was suppressed.

In contrast, in Comparative Example 1, since Vdc3=300 V was set, the bias voltage was constant from the initial time regardless of the toner replenishment amount, and the bias control in accordance with the toner replenishment amount was not performed, so that image unevenness occurred and toner scatter was remarkable.

What is claimed is:

1. An image forming method in which using a two-component developer holding body that has a magnetic member arranged thereinside and magnetically holds a developer made of a carrier and a toner, and a toner holding body that transports the toner from said two-component developer holding body and holds a toner thin layer on a surface thereof, which are provided inside of a housing, a developing bias is applied to said toner holding body and/or said two-component developer holding body to perform development of an electrostatic latent image formed on the surface of an electrostatic latent image holding body, wherein a toner collecting roller that collects scattered toner suspended in the vicinity of said toner holding body and said two-component developer holding body is arranged on the downstream side in a rotational direction of said two-component developer holding body from a closest position of said two-component developer holding body and said toner holding body, and between said two-component developer holding body and said housing wall; and a bias voltage applied to said toner collecting roller by bias means for collecting the scattered toner is controlled using a sensing result obtained by image density sensing means for sensing a density of a toner image developed on the surface of said electrostatic latent image holding body or a toner image on a transfer body onto which the toner image developed on the surface of said electrostatic latent image holding body is transferred;

wherein, based on the toner density sensed by said image density sensing means, a bias difference ΔV between said two-component developer holding body and said toner holding body is set, and said bias voltage applied to said toner collecting roller is controlled in accordance with said set bias difference ΔV; and further wherein if said toner density is higher than a predetermined density, said bias difference ΔV is changed, and then an image patch is again formed and the density of said image patch is sensed by said image density sensing means to repeatedly change said bias difference ΔV until the density reaches said predetermined density.

2. The image forming method according to claim 1, wherein if said bias difference ΔV, when the density reaches said predetermined density, is below a predetermined threshold value, said bias voltage is applied to said toner collecting roller.

3. An image forming method in which using a two-component developer holding body that has a magnetic member arranged thereinside and magnetically holds a developer made of a carrier and a toner, and a toner holding body that transports the toner from said two-component developer holding body and holds a toner thin layer on a surface thereof, which are provided inside of a housing, a developing bias is applied to said toner holding body and/or said two-component developer holding body to perform development of an electrostatic latent image formed on the surface of an electrostatic latent image holding body, wherein a toner collecting roller that collects scattered toner suspended in the vicinity of said toner holding body and said two-component developer holding body is arranged on the downstream side in a rotational direction of said two-component developer holding body from a closest position of said two-component developer holding body and said toner holding body, and between said two-component developer holding body and a housing wall; and a printing ratio is compared with a predetermined threshold value range, and in accordance with the comparison result, a bias voltage applied to said toner collecting roller by bias means for collecting the scattered toner is an AC voltage or a DC voltage, or a bias voltage obtained by superimposing a DC voltage of reverse polarity or same polarity with respect to a normal charge characteristic of the developer on an AC voltage, wherein if said printing ratio is above an upper limit value of said threshold range, a bias voltage obtained by superimposing a DC voltage of the same polarity as the normal charge characteristic of the developer on an AC voltage is applied, if said printing ratio is within said threshold range, only an AC voltage is applied, and if said printing ratio is below a lower limit of said threshold ranee a bias voltage obtained by superimposing a DC voltage of the reverse polarity to the normal charge characteristic of the developer on an AC voltage is applied.

4. The image forming method according to claim 3, wherein the upper limit value of said threshold range is 7 to 20%, and the lower limit value of said threshold range is 1 to 10%.

5. An imaging forming apparatus comprising a two-component developer holding body that has a magnetic member arranged thereinside and magnetically holds a developer made of a carrier and a toner, and a toner holding body that transports the toner from said two-component developer holding body and holds a toner thin layer on a surface thereof, which are at least provided inside of a housing, and a developing bias is applied to said toner holding body and/or said two-component developer holding body to perform development of an electrostatic latent image formed on the surface of an electrostatic latent image holding body, wherein toner replenishing means that replenishes said toner into said housing is provided;

an electrode member that collects scattered toner suspended in the vicinity of said toner holding body and said two-component developer holding body is arranged on the downstream side in a rotational direction of said two-component developer holding body from a closest position of said two-component developer holding body and said toner holding body, and between said two-component developer holding body and a housing wall; and wherein, bias means that applies a bias voltage for collecting the scattered toner to said electrode member, and control means for controlling said bias voltage in accordance with a toner replenishment amount of said toner replenishing means are provided;

wherein said toner replenishing means is provided with a toner amount detecting sensor to control the toner replenishment amount in accordance with an output value of said toner amount detecting sensor;

wherein the control of said toner replenishment amount is performed by turning ON/OFF the drive of a toner replenishing roller provided in said toner replenishing means for a predetermined time in accordance with the output value of said toner amount detecting sensor; and wherein if said toner replenishment amount exceeds a predetermined value, a DC voltage lower than a DC voltage applied to said two-component developer holding body is applied to said electrode member.

* * * * *